US009418620B2

(12) United States Patent
Ji

(10) Patent No.: US 9,418,620 B2
(45) Date of Patent: Aug. 16, 2016

(54) METHODS AND SYSTEMS FOR CONTROLLING INTERFEROMETRIC MODULATORS OF REFLECTIVE DISPLAY DEVICES

(71) Applicant: Unipel Technologies, LLC, Seattle, WA (US)

(72) Inventor: Zhong Ji, Seattle, WA (US)

(73) Assignee: Unipel Technologies, LLC, Seattle, WA (US)

( * ) Notice: Subject to any disclaimer, the term of this patent is extended or adjusted under 35 U.S.C. 154(b) by 14 days.

(21) Appl. No.: 14/282,207

(22) Filed: May 20, 2014

(65) Prior Publication Data

US 2015/0009229 A1 Jan. 8, 2015

Related U.S. Application Data

(60) Provisional application No. 61/843,491, filed on Jul. 8, 2013.

(51) Int. Cl.

| | |
|---|---|
| ***G09G 5/02*** | (2006.01) |
| ***G09G 3/34*** | (2006.01) |
| *G09G 5/06* | (2006.01) |
| *G09G 3/20* | (2006.01) |

(52) U.S. Cl.

CPC ..... *G09G 5/02* (2013.01); *G09G 3/3466* (2013.01); *G09G 3/2018* (2013.01); *G09G 3/2051* (2013.01); *G09G 3/2074* (2013.01); *G09G 3/2077* (2013.01); *G09G 5/06* (2013.01); *G09G 2300/08* (2013.01); *G09G 2330/028* (2013.01); *G09G 2340/06* (2013.01)

(58) Field of Classification Search

CPC ..... G09G 5/02; G09G 3/3629; G09G 3/3651; H04N 1/60; H04N 1/6058; H04N 1/6061

See application file for complete search history.

(56) References Cited

U.S. PATENT DOCUMENTS

| | | | |
|---|---|---|---|
| 2008/0288225 | A1 | 11/2008 | Djordjev |
| 2009/0201301 | A1 | 8/2009 | Mienko et al. |
| 2013/0050165 | A1 | 2/2013 | Northway et al. |
| 2013/0135338 | A1 | 5/2013 | Gille et al. |

OTHER PUBLICATIONS

Kotera, H., "RGB to spectral image conversion using spectral pallete and compression by SVD," in Image Processing, 2003. ICIP 2003. Proceedings. 2003 International Conference on , vol. 1, No., pp. I-461-I-464 vol. 1, Sep. 14-17, 2003 doi: 10.1109/ICIP.2003.1246998.* Kotera, Hiroaki, et al., "RGB to Spectral Image Conversion Using Spectralpaletter and Compression by SVD," (Abstract Only), Sep. 14-17, 2003.

* cited by examiner

*Primary Examiner* — Antonio A Caschera

(74) *Attorney, Agent, or Firm* — Olympic Patent Works PLLC

(57) ABSTRACT

Systems and methods process standard video signal data and control a reflective display panel to brightly display videos and images in colors selected from a broad range of colors. In certain implementations, an input video/image signal is first transformed from a RGB encoding to an encoding based on a new color system that encodes colors using spectral, black, and white components. The reflective display panel includes an array of pixels, with each pixel comprising one or more self-parallelizing interferometric modulators ("SPIMs"). Each SPIM contains a plurality of electrodes disposed on a bottom plate, a fixed top plate, and a movable plate separated by a cavity. Appropriate voltages are applied to the electrodes to vary the cavity depth of the SPIM in order for the SPIM to reflect a color of a particular wavelength or to appear black or white.

7 Claims, 23 Drawing Sheets

H = angle from red $S = \frac{d'}{d}$

L = ⊥ to black

| Wavelength(λ) | |
|---|---|
| 700 | 0 |
| .. | 1 |
| .. | 2 |
| 550 | 120 |
| .. | 121 |
| .. | 237 |
| .. | 238 |
| .. | 239 |
| 450 | 240 |

$f(\theta), \theta \in [0,240]$

FIG. 15B

| Blue ratio(*f*) | |
|---|---|
| 0.99 | 241 |
| | 242 |
| | 243 |
| | 244 |
| | 245 |
| | 246 |
| | 356 |
| | 357 |
| .. | 358 |
| 0.01 | 359 |

$f'(\theta), \theta \in [241,359]$

FIG. 15C

METHODS AND SYSTEMS FOR CONTROLLING INTERFEROMETRIC MODULATORS OF REFLECTIVE DISPLAY DEVICES

CROSS-REFERENCE TO RELATED APPLICATION

This application claims the benefit of Provisional Application No. 61/843,491, filed Jul. 8, 2013.

TECHNICAL FIELD

The present disclosure is generally related to reflective color displays, and particularly to systems and methods for controlling interferometric modulators of reflective display devices to generate high brightness across a broad range of colors.

BACKGROUND

A wide variety of display technologies have been developed to capture the characteristics of ink and paper, including transmissive liquid crystal displays ("LCDs"), reflective LCDs, electroluminescent displays, organic light-emitting diodes ("OLEDs"), electrophoretic displays, and many other display technologies. Reflective displays are a more recently developed type of display device that is gaining popularity in the market and that has already been widely used in electronic book readers. In contrast to conventional flat-panel LCD displays that require internal light sources, reflective displays utilize ambient light to display images. Reflective displays can provide images similar to those provided by traditional ink-on-paper printed materials. Due to the use of ambient light for image display, reflective displays consume substantially less power and provide more readable images in bright ambient light, than conventional displays. Currently available reflective displays are particularly effective in displaying black-and-white images. However, currently available reflective color displays can only display colors with low brightness and can only display a limited range within the full range of possible output colors, referred to as the "color gamut."

SUMMARY

The current disclosure is directed to systems and methods that process standard video signal data and image data and that control a reflective display panel to brightly display videos and images in colors selected from a broad range of colors. In certain implementations, an input video/image signal encoded in a standard format, such as a format based on the RGB color model, is first transformed from the RGB encoding to an encoding based on a new color system that encodes colors using one or more spectral colors, black, and white as color components. The reflective color display panel comprises an array of self-parallelizing interferometric modulators ("SPIMs") in rows and columns. Each pixel of an image to be processed is associated with a SPIM that contains a plurality of electrodes disposed on a bottom plate, a fixed top plate, and a movable plate separated by a cavity. Appropriate voltages are applied to the electrodes to vary the cavity depth of the SPIM in order for the SPIM to reflect a color of a particular wavelength or for the SPIM to appear black or white. In one example, temporal color dithering is used to sequentially dither color components to produce a desired color with a desired saturation and lightness.

BRIEF DESCRIPTION OF THE DRAWINGS

FIG. 15B provides an exemplary wavelength-hue look-up table for spectral hues.

FIG. 15C provides an exemplary percentage-hue look-up table for non-spectral hues.

DETAILED DESCRIPTION

Overview of Digitally-Encoded Images and Color Models

Figure 1:
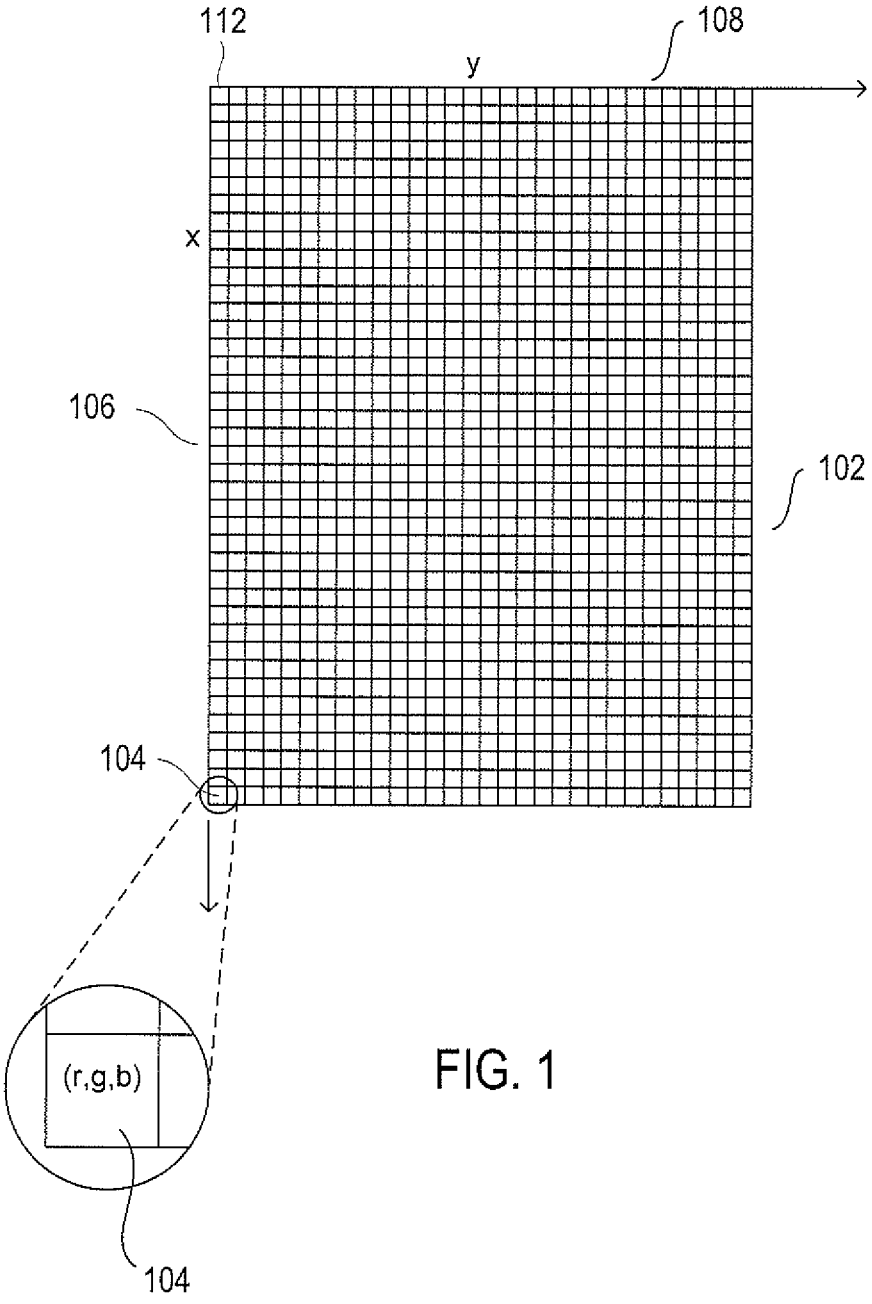
FIG. 1 illustrates a typical digitally-encoded image.

FIG. 1 illustrates a typical digitally encoded image. The encoded image comprises a two dimensional array of pixels 102. In FIG. 1, each small square, such as square 104, is a pixel, generally defined as the smallest-granularity portion of an image that is numerically specified in the digital encoding. Each pixel is a location, generally represented as a pair of numeric values corresponding to orthogonal x and y axes 106 and 108, respectively. Thus, for example, pixel 104 has x, y coordinates (39,0), while pixel 112 has coordinates (0,0). In the digital encoding, the pixel is represented by numeric values that specify how the region of the image corresponding to the pixel is to be rendered upon printing, display on a computer screen, or other display. Commonly, for black-and-white images, a single numeric value range of 0-255 is used to represent each pixel, with the numeric value corresponding to the grayscale level at which the pixel is to be rendered, with value "0" representing black and the value "255" representing white. For color images, any of a variety of different color-specifying sets of numeric values may be employed. In one common color model, as shown in FIG. 1, each pixel is associated with three values, or coordinates (r,g,b) which specify the red, green, and blue components of the color to be displayed in the region corresponding to the pixel.

Figure 2:
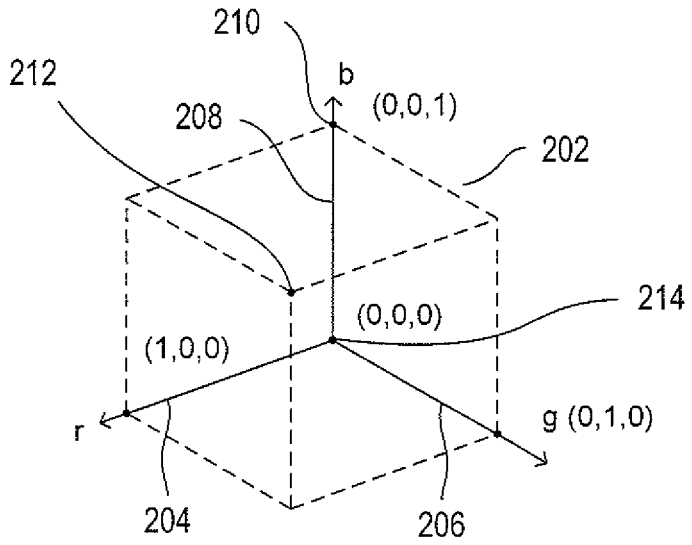
FIG. 2 illustrates one version of the RGB color model.

FIG. 2 illustrates one version of the RGB color model. The entire spectrum of colors is represented, as discussed above with reference to FIG. 1, by a three-primary-color coordinate (r,g,b). The color model can be considered to correspond to points within a unit cube 202 within a three-dimensional color space defined by three orthogonal axes: (1) r 204; (2) g 206; and (3) b 208. Thus, the individual color coordinates range from 0 to 1 along each of the three color axes. The pure blue color, for example, of greatest possible intensity corresponds to the point 210 on the b axis with coordinates (0,0,1). The color white corresponds to the point 512, with coordinates (1,1,1,) and the color black corresponds to the point 214, the origin of the coordinate system, with coordinates (0,0,0).

Figure 3:
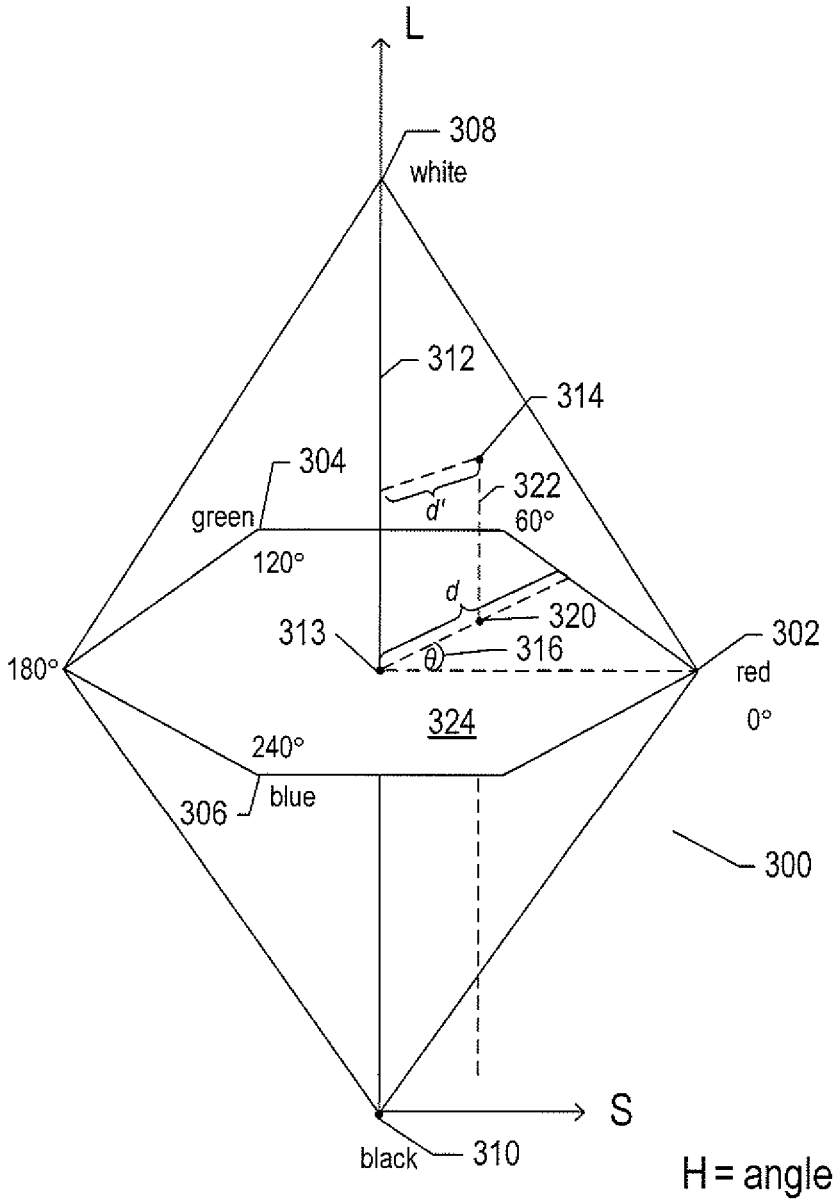
FIG. 3 shows a different color model, referred to the "hue-saturation-lightness" ("HSL") color model.

FIG. 3 shows a different color model, referred to as the "hue-saturation-lightness" ("HSL") color model. In this color model, colors are contained within a three-dimensional bi-pyramidal prism 300 with a hexagonal cross section. Hue (h) is related to the dominant wavelength of a light radiation perceived by an observer. The value of the hue varies from 0° to 360° beginning with red 302 at 0°, passing through green 304 at 120°, blue 306 at 240°, other intermediary colors, and ending with red 302 at 360°. Saturation (s), which ranges from 0 to 1, is inversely related to the amount of white and black mixed with a particular wavelength, or a hue. For example, the pure red color 302 is fully saturated, with saturation s=1.0, while the color pink has a saturation value less than 1.0 but greater than 0.0, white 308 is fully unsaturated, with s=0.0, and black 310 is also fully unsaturated, with s=0.0. Fully saturated colors fall on the perimeter of the middle hexagon that includes points 302, 304, and 306. A gray scale extends from black 310 to white 308 along the central vertical axis 312, representing fully unsaturated colors with no hue but different proportional combinations of black and white. For example, black 310 contains 100% of black and no white, white 308 contains 100% of white and no black and the origin 313 contains 50% of black and 50% of white. Lightness (l), represented by the central vertical axis 312, indicates the illumination level, ranging from 0 at black 310, with l=0.0, to 1 at white 308, with l=1.0. For an arbitrary color, represented in FIG. 3 by point 314, the hue is defined as angle θ 316, between a first vector from the origin 313 to point 302 and a second vector from the origin 313 to point 320 where a vertical line 322 that passes through point 314 intersects the plane 324 that includes the origin 313 and points 302, 304, and 306. The saturation is represented by the ratio of the distance of representative point 314 from the vertical axis 312, d', divided by the length of a horizontal line passing through point 320 from the origin 313 to the surface of the bi-pyramidal prism 300, d. The lightness is the vertical distance from representative point 314 to the vertical level of the point representing black 310. The coordinates for a particular color in the HSL color model, (h,s,l), can be obtained from the coordinates of the color in the RGB color model, (r,g,b), as follows:

$$l = \frac{(C_{max} - C_{min})}{2} \tag{1}$$

$$h = \begin{cases} 60° \times \left(\frac{g-b}{\Delta} \bmod 6\right), & \text{when } C_{max} = r \\ 60° \times \left(\frac{b-r}{\Delta} + 2\right), & \text{when } C_{max} = g \\ 60° \times \left(\frac{r-g}{\Delta} + 4\right), & \text{when } C_{max} = b \end{cases} \tag{2}$$

$$s = \begin{cases} 0, & \Delta = 0 \\ \frac{\Delta}{1 - |2l - 1|}, & \text{otherwise} \end{cases} \tag{3}$$

where r, g, and b values are intensities of red, green, and blue primaries normalized to the range [0, 1]; $C_{max}$ is a normalized intensity value equal to the maximum of r, g, and b; $C_{min}$ is a normalized intensity value equal to the minimum of r, g, and b; and Δ is defined as $C_{max}-C_{min}$.

Figure 4:
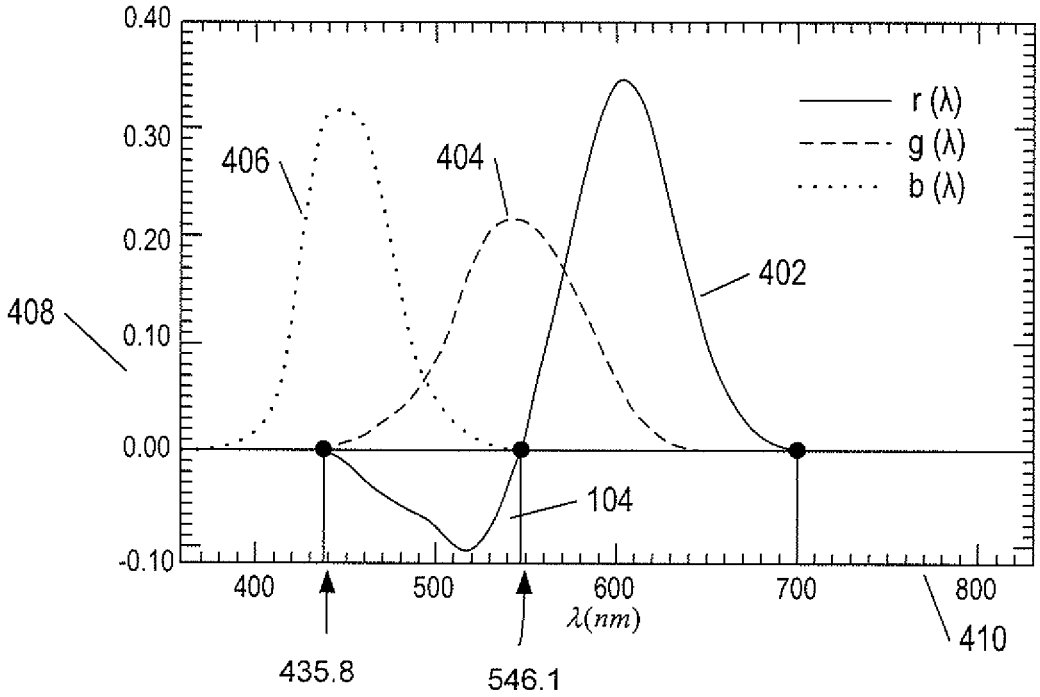
FIG. 4 shows color-matching functions for red, green, and blue.

FIG. 4 shows color-matching functions for red, green, and blue. The vertical axis 408 represents tristimulus values of the RGB primaries and the horizontal axis 410 represents wavelength λ in nanometers. The phrase "tristimulus value" refers to the relative intensity of a primary used in a combination of primaries to produce a perceived spectral color. It is known that under certain lighting conditions a particular combination of RGB can match most monochromatic colors that are visible to human eyes. A given color C can be represented by the trichromatic equation:

$$C = B\vec{b} + G\vec{g} + R\vec{r}$$

where $\vec{r}$, $\vec{g}$, and $\vec{b}$ represent the three primaries, red, green, and blue and the three quantities R, G, and B are the magnitudes or relative intensities of each corresponding primary used to match the given color C. The magnitudes or relative intensities R, G, and B are referred to as the "tristimulus values" with respect to the red, green, and blue primaries. However, colors in the wavelength range between 435.8 nm and 546.1 nm cannot be matched by additively combining RGB primaries. Instead, some red needs to be subtracted in order to cover the entire range of color perception.

Figure 5:
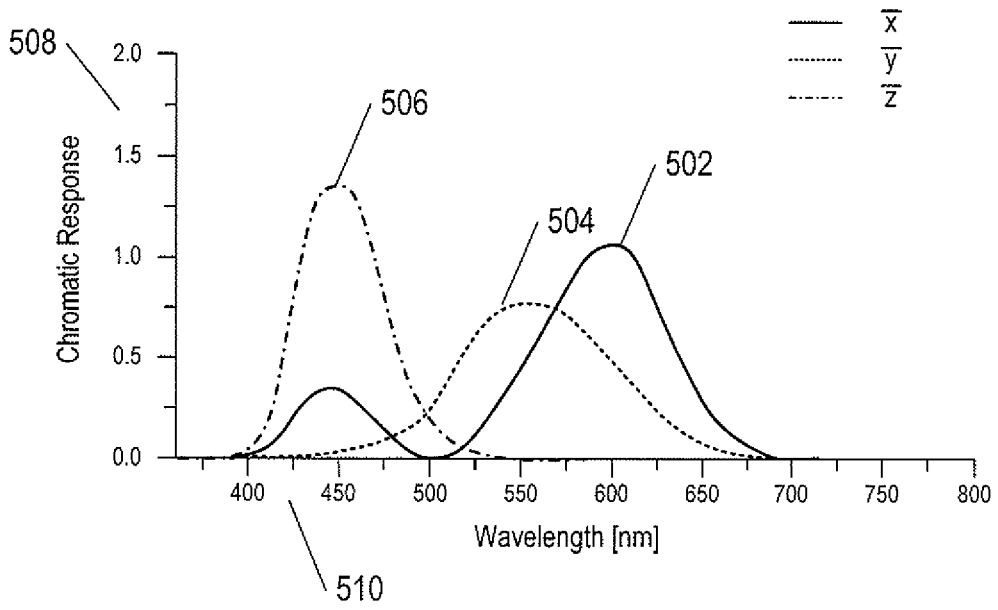
FIG. 5 shows the CIE 1931 xyz color-matching functions.

FIG. 5 shows the CIE-1931 xyz color-matching functions 502-506. The vertical axis 508 represents tristimulus values for CIE-1931 xyz color-matching functions 502-506 and the horizontal axis 510 represents the wavelength λ in nanometers. The acronym "CIE" stands for "Commision Internationale de l'Eclairage". In 1931, the CIE established standards for color representation based on the physiological perception of light by human eyes. The CIE system is built upon a set of three CIE color-matching functions, $\vec{x}$ 502, $\vec{y}$ 504, and $\vec{z}$ 506, collectively referred to as the "Standard Observer", related to the red, green, and blue cones in human eyes. Similar to the RGB color-matching function shown in FIG. 4, $\vec{x}$, $\vec{y}$, and $\vec{z}$ represent three primaries and the three tristimulus values X, Y, and Z are the relative intensities of each corresponding primary used to match a given color. The color-matching function $\vec{y}$ 504 is chosen to match the luminance information about a color, which is the amount of energy emanating from a light source or incident upon the retina of an eye, photographic film, or a charge-coupled device.

Figure 6:
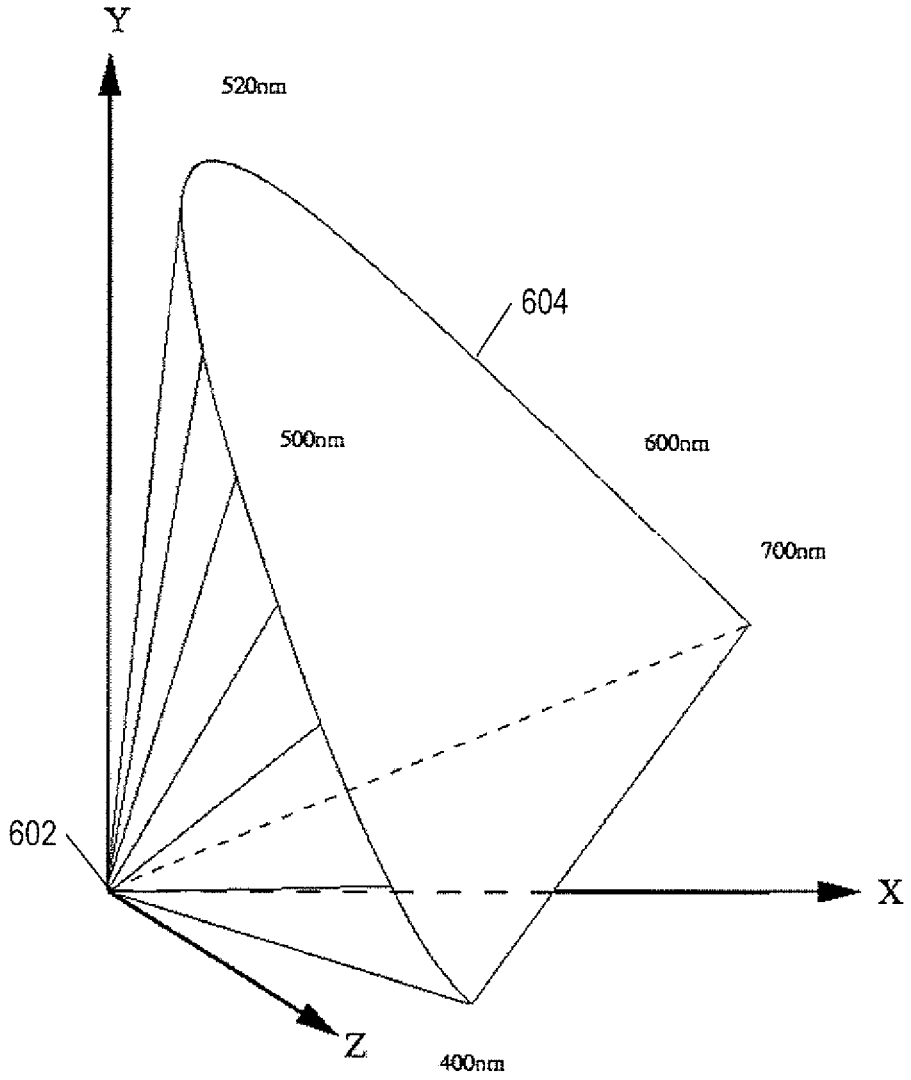
FIG. 6 illustrates a CIE XYZ color model

FIG. 6 shows a CIE XYZ color model. The CIE XYZ color model shown in FIG. 6 is one of many CIE color models currently in use and is based on the $\bar{x}$ 502, $\bar{y}$ 504, and $\bar{z}$ 506 color-matching functions shown in FIG. 5. The X, Y, and Z axes in the CIE XYZ color model each represent one of the three tristimulus values X, Y, and Z discussed above. Unlike the RGB color model discussed above, color model is not device dependent, but is instead designed to the CIE XYZ correspond to human perception of colors. The origin 602 corresponds to black. The curved boundary 604 of the cone-shaped CIE XYZ color model represents the tristimulus values of pure monochromatic colors. The coordinates for a particular color in the CIE XYZ color model, (X,Y,Z), can be obtained from the coordinates of the color in the RGB color model, (r,g,b), as follows:

$$X=0.412453*r+0.35758*g+0.180423*b; \quad (4)$$

$$Y=0.212671*r+0.71516*g+0.072169*b; \quad (5)$$

$$Z=0.019334*r\pm0.119193*g+0.950227*b; \quad (6)$$

Figure 7:
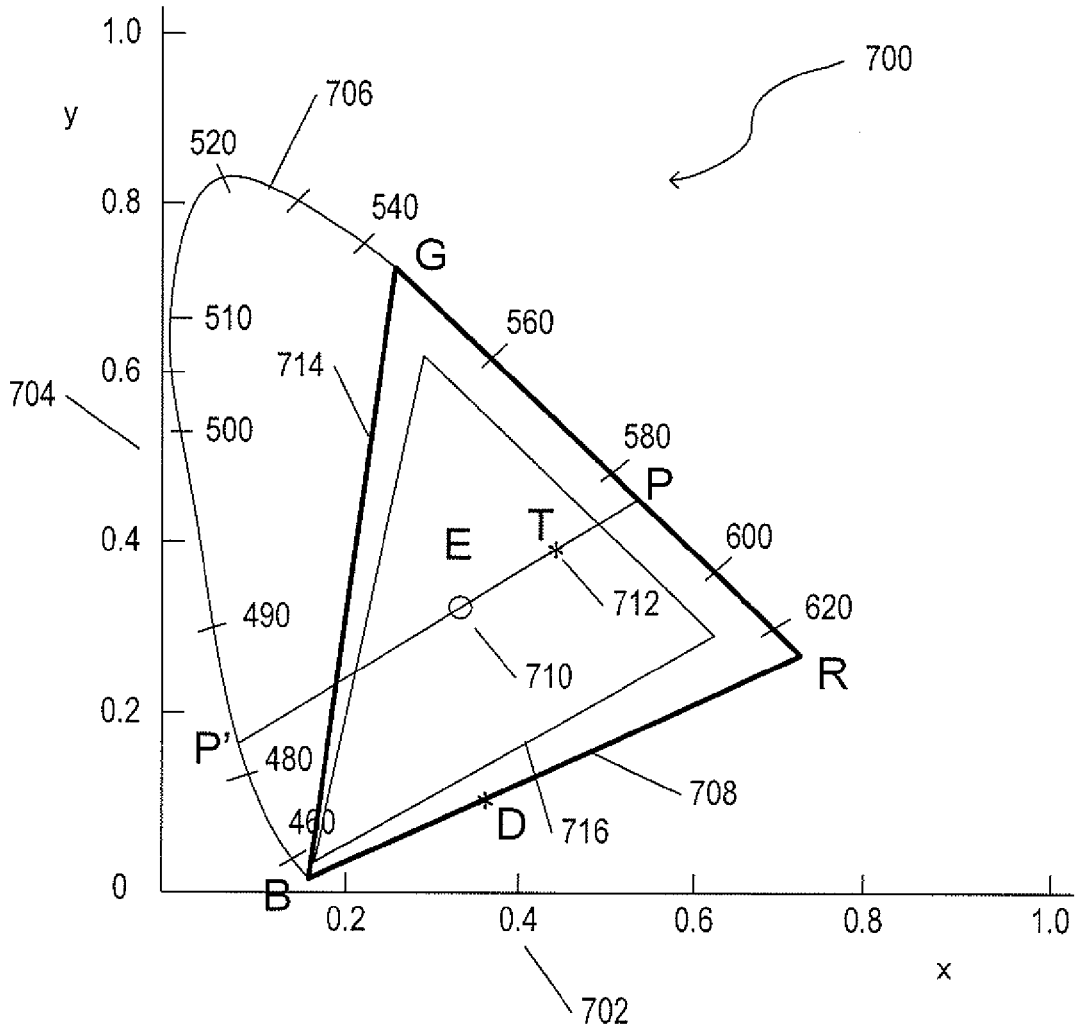
FIG. 7 shows the CIE 1931 chromaticity diagram.

FIG. 7 shows the CIE 1931 chromaticity diagram. The chromaticity diagram 700 is a two-dimensional projection of the three-dimensional CIE XYZ color model shown in FIG. 6. The chromaticity diagram 700 represents the mapping of human color perception in terms of two CIE coordinates (x,y) corresponding to the x and y axes 702 and 704, respectively. In the CIE 1931 chromaticity diagram, x and y parameters, also referred to as "chromaticity values", are determined as the proportion of X and Y relative to the sum of all three tristimulus values, and can be defined as:

$$x = \frac{X}{X+Y+Z} \quad (7)$$

$$y = \frac{Y}{X+Y+Z} \quad (8)$$

where X, Y, and Z are CIE tristimulus values. The sum of X, Y, and Z is equal to 1.0. The x and y parameters convey the chromatic content of a sample color.

When plotted in the xy notation, as shown in FIG. 7, the pure monochromatic colors of the spectrum form a horseshoe shape that encompasses all the hues that are perceivable to normal human eyes. The curved edge 706 of the gamut is called the spectral locus and corresponds to spectral colors. Each point on the curved edge represents a unique perceivable hue of a single wavelength, with the wavelength listed in nanometers, including 540 and 560. All other non-spectral, less saturated colors fall within the horseshoe shape. The degree of saturation of a color represented by a point within the horseshoe-shaped region is inversely related to the shortest distance of the point from the spectral locus. The straight line 708 on the lower part of the horseshoe shape, also called the line of purples, represents the purple colors that cannot be produced using a spectral color with a single wavelength. The purple colors can be produced by mixing different combinations of blue and red. For a given purple color D, a blue ratio is calculated as the ratio of the distance from point B at one end of the purple line to point D divided by the distance from point B to point R at the other end of the purple line. White point E 710 is located in the center of the horseshoe and represents a set of chromaticity coordinates that define white. For a given perceived color, for example, color T 712, a straight line connecting color T and white point E can be extrapolated to two intersection points P and P' on the spectral locus. Point P, nearer to color T, reveals the dominant wavelength of color T, while point P' reveals the complementary wavelength. The two points P and P' define a complementary color pair. Mixing portions of two complementary colors produces white.

The color gamut of a given display panel is defined by the location of a set of primary colors in the chromaticity diagram. All the colors that can be realized by combining three RGB primaries of a particular RGB color model is bounded by a Maxwell triangle for that RGB color model, for example triangles 714 and 716 as shown in FIG. 7, formed by the three red, green, and blue vertices. The colors enclosed by the spectral locus but outside the Maxwell triangle cannot be produced by adding the three primaries of the RGB color model. Triangle 714 in FIG. 7 represents the colors that can be obtained by combining the primaries of a CIE RGB color model, while triangle 716 represents the colors that can be obtained by combining primaries of an sRGB color model. The sRGB color model is a standard RGB color model created cooperatively by Hewlett-Packard™® and Microsoft™® and commonly used on monitors, printers, and the Internet.

CIE LUV and CIE LAB color models are two different color models derived from the CIE XYZ color model that are considered to be perceptually uniform. The acronym "LUV" stands for the three dimensions L*, u*, and v*, used to define the CIE LUV color model, while the acronym "LAB" stands for the three dimensions L*, a*, and b*, used to define the CIE LAB color model. As one example, in the CIELUV color model, the CIELUV coordinates, L*, u*, and v* can be calculated from the tristimulus values XYZ using the following formulas (9-14), in which the subscript n denotes the corresponding values for the white point.

$$L^*=116(Y/Y_n)^{1/3}-16 \text{ (for } Y/Y_n>0.008856); \quad (9)$$

$$L^*=903.3(Y/Y_n) \text{ (for } Y/Y_n<0.008856); \quad (10)$$

$$u^*=13L^*\cdot(u'-u'_n); \quad (11)$$

$$v^*=13L^*\cdot(v'-v'_n); \quad (12)$$

(13)

$$u' = \frac{4X}{X+15Y+3Z}; \quad (14)$$

$$v' = \frac{9Y}{X+15Y+3Z}.$$

There are a variety of different, alternative color models, some suited to specifying colors of printed images and others more suitable for images displayed on CRT screens or LCD screens. In many cases, the components or coordinates that specify a particular color in one color model can be easily transformed to coordinates or values in another color model, as shown in the above examples by equations that transform RGB color coordinates to HSL color coordinates and by equations that transform CIE XYZ color coordinates to CIE LUV color coordinates. In other cases, such as converting from RGB colors to CIE LUV colors, the device-dependent RGB colors are first converted into a device-independent RGB color model and then, in a second step, transformed from the device-independent RGB color model to the CIE LUV color model.

Color Generation Using RGB Primaries

Engineers seek to create a display technology capable of providing a paper-like reading experience, not only with regards to appearance, but also with respect to cost, power consumption, and ease of manufacture. A wide variety of display technologies have been developed to capture the characteristics of ink and paper, including transmissive liquid crystal displays ("LCDs"), reflective LCDs, electroluminescent displays, organic light-emitting diodes ("LEDs"), and electrophoretic displays. A transmissive LCD consists of two transmissive substrates between which a liquid crystal panel resides. By placing a backlight underneath one of the transmissive substrates and by applying a voltage to the liquid crystal, the light reaching the observer can be modulated to make the display pixel appear bright or dark. A display can also directly emit light, as in the case of an OLED display. In a reflective display, one of the transmissive substrates is replaced with a reflective substrate. Color ink or pigment is applied on top of the reflective substrate to modulate the ambient light reflecting off from the reflective substrate. The more ambient light, the brighter the display appears. This attribute simulates the response of traditional ink and paper, as a result of which reflective displays are also referred to as "E-ink" or "E-paper". Since reflective displays eliminate the need for a backlight, substantially less power is consumed in reflective displays than in emissive/transmissive displays.

Figure 8A:
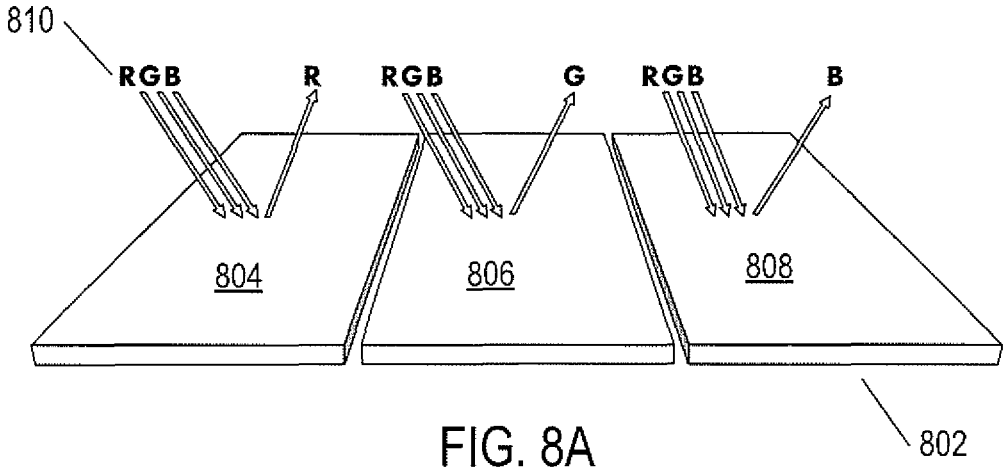
FIG. 8A shows RGB sub-pixels of a pixel that reflects a white color in a reflective display.

Traditionally, colors are produced in displays by combining different proportions of primary colors using spatial color dithering, temporal color dithering, or a combination of both. In spatial dithering, the color of a pixel is generated by controlling sub-pixels. FIG. 8A shows RGB sub-pixels of a pixel that reflects white in a reflective display. The pixel 802 is composed of three sub-pixels of red 804, green 806, and blue 808 positioned side-by-side on a color filter. For a given pixel, one third of its area is generally allocated to each of the three sub-pixels that represent each of the three primary colors. Each sub-pixel toggles between black and its designated color. White is realized by activating all three sub-pixels. Because the sub-pixels are smaller than minimum dimensions distinguishable by the human eye, a color mixing effect is produced, and the pixel appears to be white. Each sub-pixel reflects only a portion of the incident light with wavelengths falling within a range of wavelengths that include the RGB primary represented by the sub-pixel. As a result, on average, the pixel reflects only one third of the light impinging on the pixel.

Figure 8B:
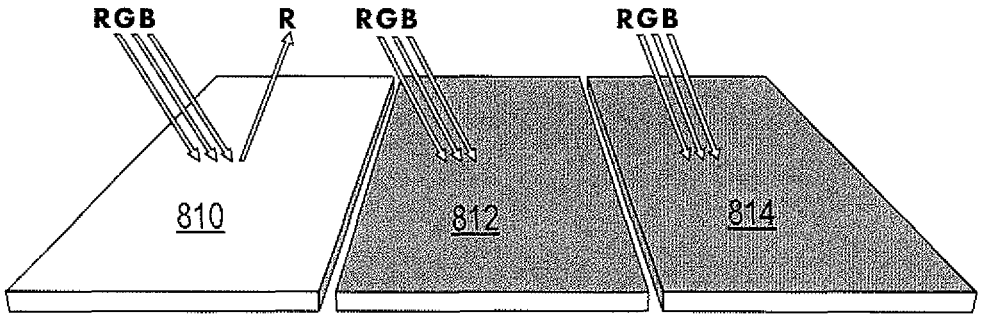
FIG. 8B shows RGB sub-pixels of a pixel that reflects a saturated red color in a reflective display.

FIG. 8B shows RGB sub-pixels of a pixel that reflects a saturated red color in a reflective display. For a pixel to realize fully saturated red, the red sub-pixel 810 reflects red and the green and blue sub-pixels 812 and 814 are non-reflective, as shown in FIG. 8B. As a result, one third of fully saturated red is mixed with two thirds of black.

Figure 9A:
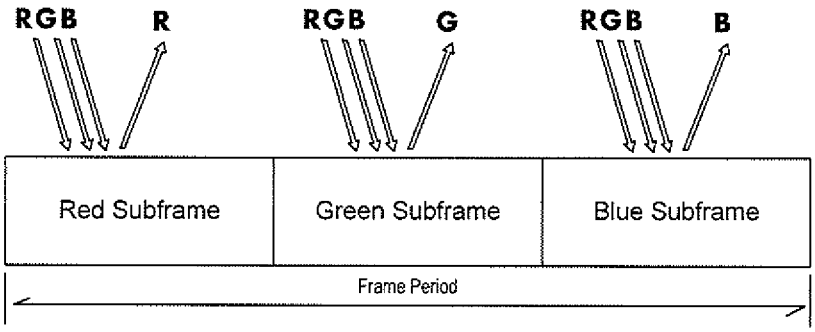
FIG. 9A shows a pixel that appears white using temporal color dithering in a reflective display.

In temporal color dithering, there is no need to divide a pixel into sub-pixels to achieve the color mixing effect. Instead, primary colors are produced sequentially by the pixel during a short time period, referred to as a "frame." In order to drive the display of different primary colors within a frame, the frame is subdivided into sub-frames, each sub-frame corresponding to a primary color. Thus, each frame has as many sub-frames as the system has different primary colors. FIG. 9A shows a pixel that reflects white using temporal color dithering in a reflective display. For a system that uses red, green, and blue primary colors, there are three sub-frames within each frame to accommodate each of these three primary colors. To realize white, each of the primary colors is reflected sequentially during the frame period, one primary color in each sub-frame. Red is reflected during a first sub-frame, green is reflected during a second sub-frame, and blue is reflected during a third sub-frame. The frame rate is sufficiently fast that human eye does not perceive each different primary color produced during a sub-frame, but instead perceives a color that results from mixing the primary colors. Reflection of a particular primary color can be achieved by many different technologies, one of which is based on optical interference and is described, in detail, in the following section. Because each sub-frame is dedicated to one of the primary colors, the other two primary colors in the incident light are not reflected during each sub-frame period. For example, the first sub-frame is dedicated to red, and blue and green primaries are not reflected.

Figure 9B:
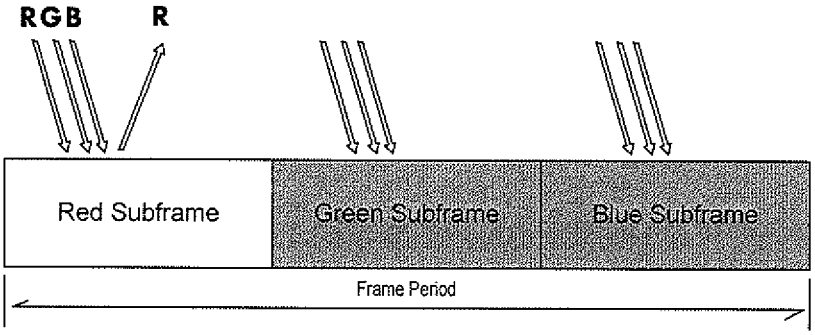
FIG. 9B shows a pixel that reflects a saturated red color using temporal color dithering in a reflective display

FIG. 9B shows a pixel that reflects a saturated red color using temporal color dithering in a reflective display. For a pixel to realize fully saturated red, red is reflected during the dedicated red sub-frame and no reflection occurs in the sub-frames dedicated to green and blue. Hence again, as in spatial color dithering, only a third of the incident light is reflected, on average, resulting in a generally dim display.

The RGB primaries are convenient for mixing colors for emissive and transmisive displays, but, since each pixel is divided into three sub-pixels, the efficiency of reflection is low on a per-pixel basis. The low efficiency is not apparent in emissive/transmisive displays because the intensity of emissive light sources can be sufficiently increased to provide bright displays when ambient light is relatively weak. But the low efficiency becomes problematic in reflective displays because there is no backlight in reflective displays.

Full-Spectral Interferometric Modulator

Figure 10:
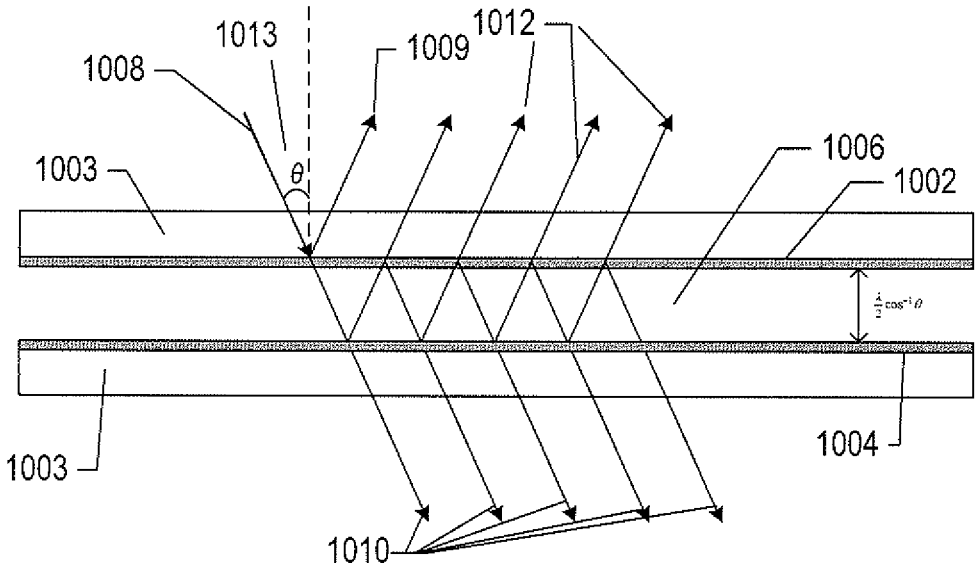
FIG. 10 is a side view of a Fabry-Perot Interferometer

Microelectromechanical-system (MEMS) based reflective display technologies have been under development for over a decade and have recently started to gain acceptance in the market. Some reflective-display technologies use interferometric modulation that is based on a Fabry-Perot Interferometer ("FPI"). FIG. 10 is a side view of an FPI. The FPI has two parallel mirrors, a top mirror 1002 and a bottom mirror 1004. The mirrors are commonly produced by coating a transparent or semi-transparent substrate 103 with a reflective material. The two parallel mirrors are separated by a cavity 1006. Incident light beam 1008 enters the FPI from an incident side, travels through top mirror 1002, experiences multiple reflections between the two mirrors 1002 and 1004, and exits from the cavity as transmitted light beams 1010 and reflected light beams 1012 from the bottom mirror and the top mirror, respectively. Depending on the depth of the cavity 1006 and angle of incidence θ 1013, the light exiting the FPI generally experiences either constructive or destructive interference.

For the exemplary FPI shown in FIG. 10, the refractive index of cavity 1006 is less than that of the mirror-coated media 1003. A primary reflected beam 1009 from top mirror 1002 experiences phase inversion when the mirror is metallic film or coating. Light transmitted through the top mirror 1002 is incident on the bottom mirror 1004, and splits into transmitted components 1010 and reflected components 1012. The reflected light beam 1012 comprising the reflected components experiences phase inversion upon its reflection from the bottom mirror 1004, travels back through cavity 1006, and joins the primary reflected beam 1009. The primary reflected beam 1009 and the reflected beam 1012 are in phase when the following relationship is satisfied for gaseous media:

$$\lambda = 2d \cos \theta$$

where λ is the wavelength of the incident light; d is the cavity depth; and θ is the angle of incidence. Therefore, light of a specific wavelength experiences full constructive interference on the reflective side when the round-trip length through the cavity is equal to an integer multiple of that wavelength. On the transmission side, however, the transmitted light beam 1010 of the same specific wavelength comprising transmitted components experiences fully destructive interference when the above relationship is satisfied. As a result, the mirrors and cavity act as a filter that reflects light of a specific wavelength through the device, and transmits light of other wavelengths. By controlling the depth of the cavity 1006 and the angle of incidence, the state of the interferometer can be changed, with each state corresponding to a different reflective color. For the sake of simplicity, in the following discussions, it is assumed that the incident light is perpendicular to the top mirror. For example, when the cavity depth equals half of the wavelength of red light and the incident light is perpendicular to the top mirror, the FPI reflects light of a red color and transmits light of a cyan color. Similarly, when the cavity depth equals 225 nm, half of the wavelength of blue light, and the incident light is perpendicular to the top mirror, the FPI reflects light of a blue color and transmits light of a yellow color. When the cavity depth is greater than or equal to a first threshold value and less than 190 nm, corresponding to half of the wavelength of ultraviolet, most of the visible light destructively interferes, resulting in no reflected visible light, so that the display appears black. Black can also be generated by controlling the FPI to reflect light of infrared wavelengths, which are not visible to human eye. White is generated when the cavity depth is less than or equal to a second threshold value that is less than the first threshold value. White can also be generated when the two mirror are far apart relative to visible-light wavelengths, for example, greater than 1500 nm. When the cavity depth is greater than the second threshold value and less than the first threshold value, a gray color may be generated. The values of the first and second threshold may vary in different FPIs, depending on the angle of incidence and other factors.

Interferometric modulators using three RGB sub-pixels are known in the market. But like other RGB-based reflective color displays, interferometric modulators using RGB primaries are subject to the previously described problem of low reflectivity.

In an alternative approach to reflective display, spectral or monochromatic colors may be generated in place of RGB primary colors. Interferometric modulators using a single full-spectral pixel can reflect any spectral color and can improve reflection efficiency by eliminating the need for sub-pixels. The cavity depth of the full-spectral interferometric modulator can be adjusted according to the dominant wavelength of a desired color. The entire surface area of the full-spectral pixel associated with the interferometric modulator can then be used to reflect the spectral color associated with the dominant wavelength. As a result, the pixel achieves 100% reflectivity and appears three times brighter than a pixel that generates an equivalent color by mixing RGB primaries.

Interferometric modulators capable of reflecting spectral colors are difficult to manufacture due to the need for stringent fabrication precision. The two reflective layers in the interferometric modulator need to be strictly parallel when the modulator is both actuated and unactuated. Any tilting of the mirror surface will lead to rainbow stripes on the modulator and a generally gray appearance.

Figure 11A:
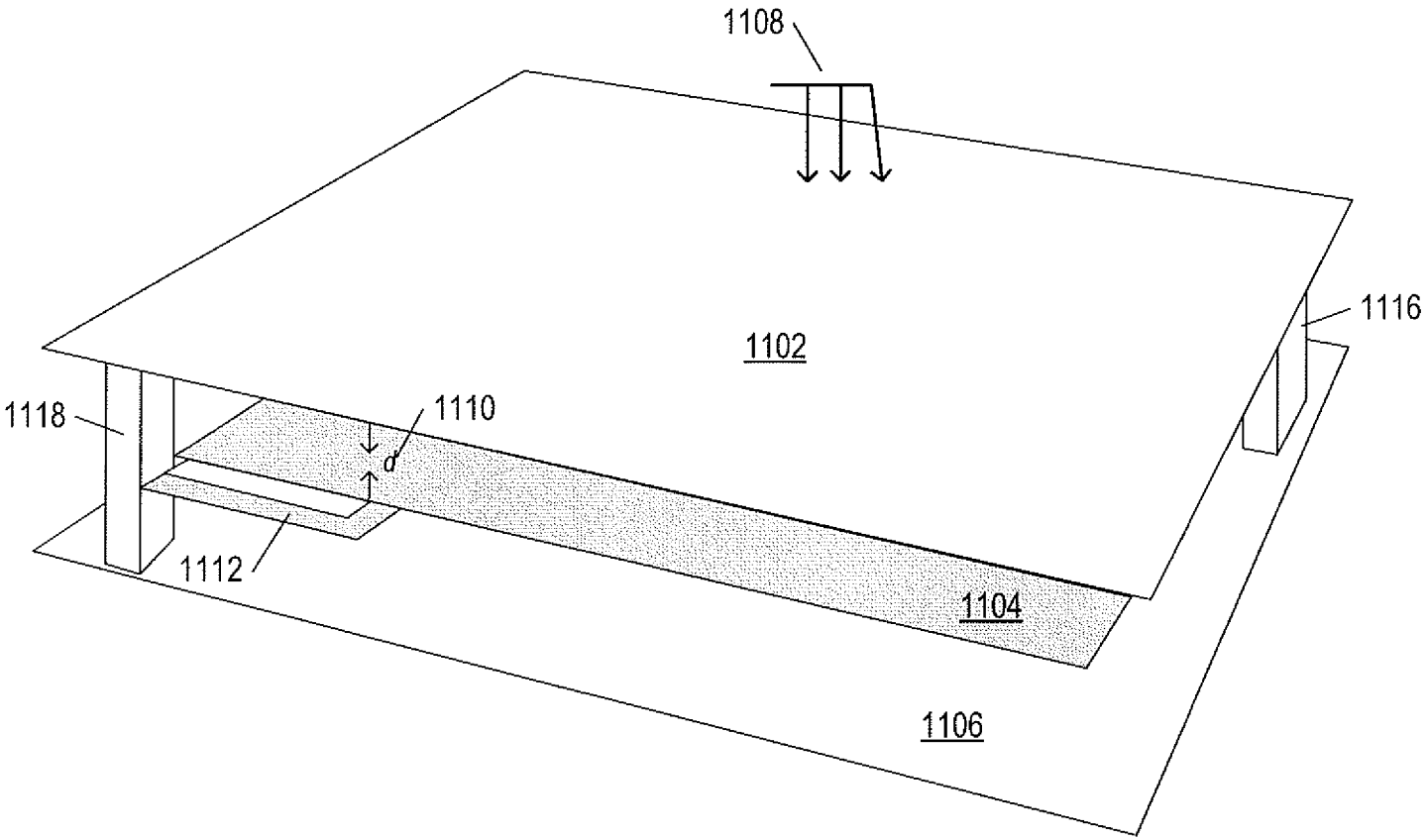
FIG. 11A is an isometric view of a self-parallelizing interferometric modulator ("SPIM")
Figure 11B:
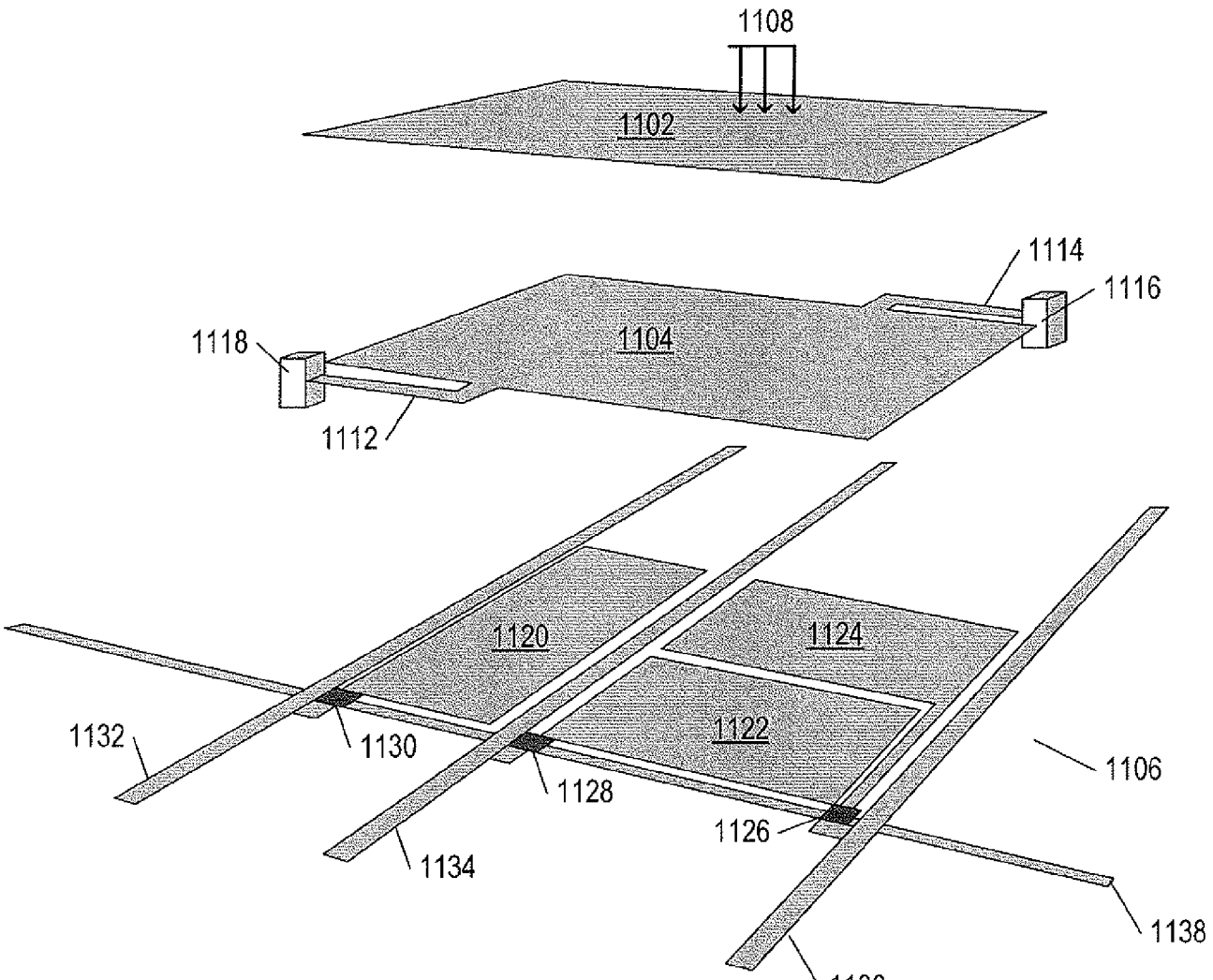
FIG. 11B is an exploded view of a SPIM.

An interferometric modulator that maintains a parallel orientation between the mirrors has been recently developed. This new type of interferometric modulator is referred to, below, as a self-parallelizing interferometric modulator ("SPIM"). Even though the depicted pixel in this example is squared, it can also be of different shape, such as circular, hexagon, and triangle. FIG. 11A is an isometric view of the SPIM and FIG. 11B is an exploded view of the SPIM. The SPIM 1100 has a transparent fixed plate 1102, a movable plate 1104, and a bottom control plate 1106. The fixed plate 1102 faces the full-spectrum incident light 1108 on one side and has a semi-reflective mirror coating on the other side. The movable plate 1104, with a mirror on its top side, is coated or formed with an electrically conductive film. A distance between the fixed plate 1102 and the movable plate 1104 defines the depth of cavity 1110, which is used to modulate light transmitted into the cavity. The bottom control plate 1106 underneath the movable plate 1104 is coated with an electrode that faces upwardly and may be patterned in a plurality of areas that can be independently provided with voltages to enable anti-tiling compensation of the movable plate. A plurality of spring beams 1112 and 1114 are anchored to a plurality of supporting fixed posts 1116 and 1118. The supporting fixed posts provide support to suspend the movable plate 1104 through the spring beams to a particular vertical position when the movable plate 1104 is driven.

The movable plate 1104 is actuated by applying voltages to the plurality of electrodes disposed on the bottom plate and the electrically conductive movable plate. Conductors or drivers are coupled to the electrodes on the bottom plate and to the movable plate and are configured to be coupled to a controlled voltage source in order to enable predefined voltages to be applied to each of the electrodes. In certain implementations, the bottom control plate 1106 includes three spaced-apart electrodes 1120, 1122, and 1124, shown in FIG. 11B. When voltages are applied to electrodes 1120-1124 to actuate the movable plate 1104, the movable plate moves downwardly, increasing the cavity depth 1110. When the spring beams 1112 and 1114 are perfectly balanced and when voltages applied to electrodes 1120. 1122, and 1124 are identical, the movable plate 1104 remains parallel to the fixed plate 1102. Any tilting can be eliminated by applying different voltages to the electrodes in order to compensate for the mechanical imbalance. The compensating voltages may be determined after the modulator has been fabricated and included in a display and then subsequently applied driving display operations.

Figure 11C:
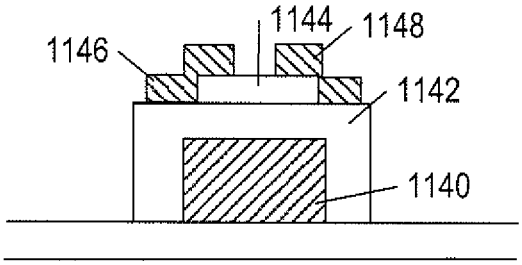
FIG. 11C is a cross-section view of a TFT used in one implementation of a SPIM.

Referring to FIG. 11B, when three electrodes are disposed on the bottom control plate, three thin-film transistors ("TFTs") 1126, 1128, and 1130 may be used for active-matrix addressing to actuate the SPIM. The three electrodes 1120, 1122, and 1124 are connected to three data lines 1132, 1134, and 1136 and one gate line 1138 through the three transistors 1126, 1128, and 1130. FIG. 11C shows a cross-section view of a TFT used in the SPIM. The TFT comprises a gate 1140, a gate insulating layer 1142, a semiconductor layer 1144, a source 1146, and a drain 1148. The TFT can be switched on by applying a voltage to the gate 1140 connected to the gate line 1138. Once the TFT is switched on, a data voltage is applied to the source 1146 and transferred through the drain 1148 from one of the data lines 1132, 1134, and 1136 to one of the electrodes 1114, 1116, and 1118. Application of an appropriate predefined voltage to each of the three data lines 1132, 1134, and 1136 that are connected to each of the three electrodes 1114, 1116, and 1118 produces an electrostatic attraction that vertically moves the movable plate 1104, changing the depth of the cavity 1110.

Figure 12A:
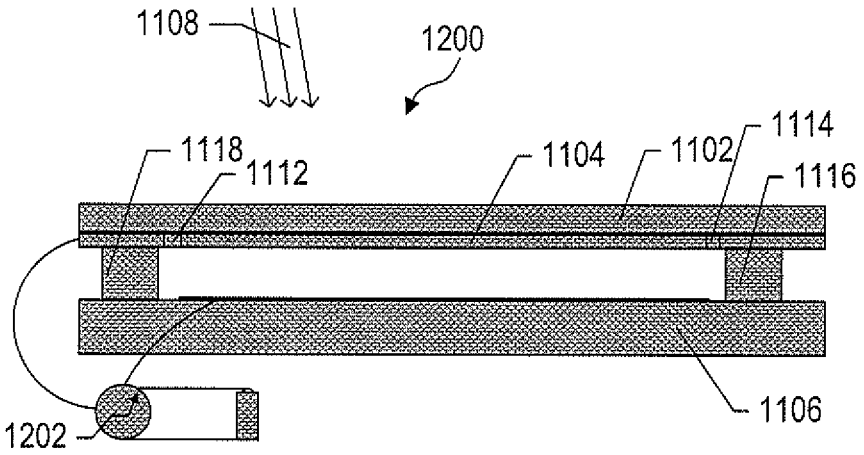
FIG. 12A illustrates a cross-section view of a SPIM when the movable plate is not actuated.
Figure 12B:
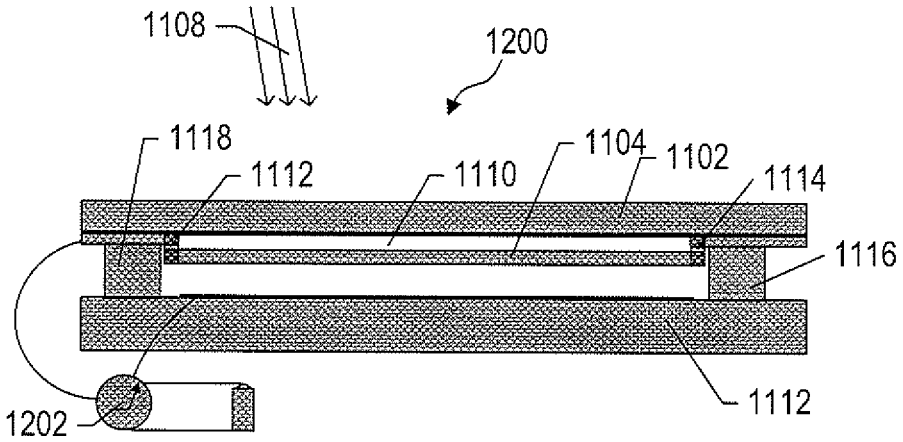
FIG. 12B illustrates a cross-section view of a SPIM when the movable plate is actuated.

FIG. 12A illustrates a cross-section view of the SPIM when the movable plate is not actuated. FIG. 12B illustrates a cross-section view of the SPIM when the movable plate is actuated. In FIG. 12A, the top fixed plate 1102 and the movable plate 1104 are in contact with each other when the SPIM is not actuated and in its un-driven state, so that the modulator reflects no visible light. When the modulator is actuated or driven, as shown in FIG. 12B, cavity 1110 is formed between the two plates, and the depth of this cavity determines the wavelength of light reflected by the modulator. The elements of the modulator rest on the two supporting fixed posts 1116 and 1118 attached to the top fixed plate and to the bottom plate 1106. The movable plate 1104 is maintained parallel to the fixed plate 1102. When the movable plate 1104 is actuated by applying a voltage 1202 to the electrodes on the bottom control plate 1106 and the movable plate 1104, an electrostatic force pulls the movable plate 1104 away from the fixed plate 1102 and toward the bottom control plate 1106. The depth of the cavity 1110 is controlled by the level of the applied voltage and the restoring force provided by spring beams 1112 and 1114 of the movable plate. The spring beams act as springs that pull the movable plate 1104 back to its original un-driven state when the voltage is no longer applied to the electrodes.

Since each modulator is a full-spectral pixel, the entire pixel area can be used to reflect a color, thus greatly increasing the reflection efficiency. Colors along the spectral locus shown in the chromaticity diagram in FIG. 7 can be produced by controlling the movable plate of the SPIM to reflect a color of a particular wavelength. Colors along the line of purples can be produced by mixing a reflected blue and red. To depict a color with less lightness and saturation, spectral colors may be blended with a fraction of white and black. Thus, different proportional combinations of a spectral color, black, and white components can be used to produce the full spectrum of colors in the chromaticity diagram. By replacing RGB primaries with a new set of color-model components, namely a spectral color along the spectral locus, black, and white, to drive the SPIM, the reflection efficiency is increased and the color gamut can be substantially extended to cover an area in the chromaticity diagram not previously realizable using a RGB color model.

The movable plate in the SPIM can be controlled to occupy various positions to generate spectral colors continuous in wavelength. The visible spectrum in the range of [400 nm, 700 nm] may be divided into N levels, also called the levels of hues. The division may be evenly or unevenly distributed over the wavelength range. Alternatively, colors may also be digitized into a number of discrete levels. The number of discrete levels of spectral color should be properly selected in order to optimize the color performance of a reflective display and to minimize processing overheads. An ideal number of levels allows for a wide range of colors while still minimizing the number of bits needed to represent each color. In certain implementations, a 5-bit digital encoding is selected to represent the analog wavelength from 400 nm to 700 nm. To convert the continuous analog wavelength to a digital 5-bit representation, the wavelength range [400,700] is partitioned into $2^5$ or 32 discrete levels with a step size, also called resolution $r=700\text{-}400/2^5$ that defines the smallest analog change resulting from changing one bit in digital number. In other implementations, a 10-bit digital encoding is selected to represent the analog wavelength from 400 nm to 700 nm, resulting in $2^{10}$ or 1024 discrete levels with a resolution $r=700-400/2^{10}$.

Color Generation Using One or More Spectral Colors, Black, and White

A new color model is introduced in this section and used as a basis to drive the SPIM described in the previous section. In this color model, a given non-purple color is represented by three color components: a spectral color, black, and white. The new-color-model coordinates of the given non-purple color contain four values: the wavelength associated with the spectral color $\lambda$, a percentage of the spectral color $P_s$, a percentage of black $P_k$, and a percentage of white $P_w$. Alternatively, one of the percentages may be omitted from the coordinate system as the sum of the three percentages is 1.0. Different proportional combinations of a chosen spectral color, black, and white can produce the entire spectrum of colors in the chromaticity diagram except purple colors. Purple colors can be represented by combinations of four color components: blue, red, black, and white. The new-color-model coordinates for a given purple color also contain four values: a percentage of blue $P_b$, a percentage of red $P_r$, a percentage of black $P_k$, and a percentage of white $P_w$. The sum of $P_b$, $P_r$, $P_k$, and $P_w$ is equal to 1.0.

Images and videos input to a SPIM-based reflective display generally needs to be transformed from RGB encodings to encodings that use the color coordinates of the new color model. As one example, the encoding may encode pixel color values as quadruple values of a wavelength of a spectral color, a percentage of the spectral color, a percentage of black, and a percentage of white. Because of many years of development of CRT, plasma, LCD, and other light emissive and transmissive displays, video and image data is generally encoded in a RGB color model for electronic display and in cyan-magenta-yellow ("CMY") for hardcopy devices. Therefore, input data generally needs to be transformed from a device-dependent color model defined by primary color components, such as RGB, to the new color model in order to drive a SPIM-based display.

Figure 13A:
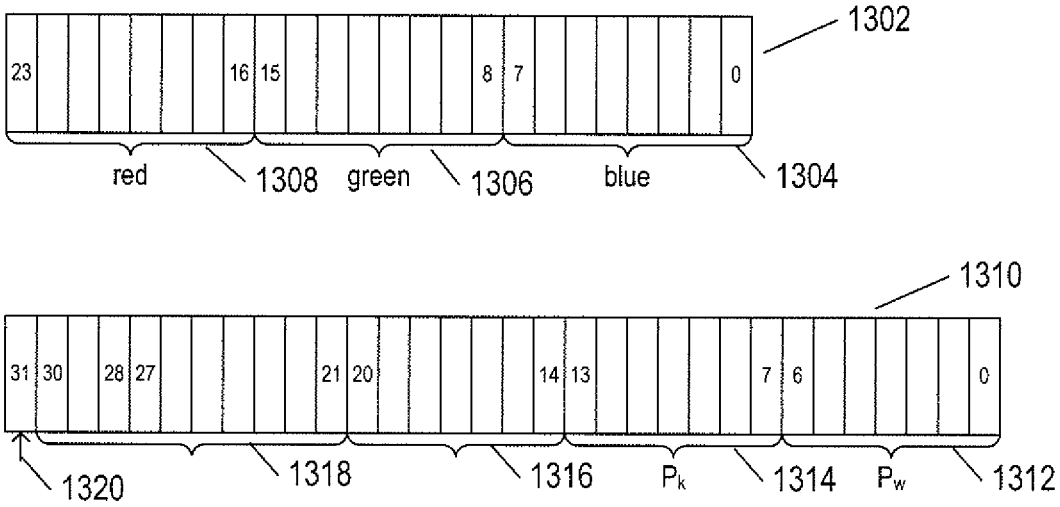
FIG. 13A is a diagram illustrating a 24-bit RGB representation of a pixel and a 32-bit representation of a pixel in the new color model.

FIG. 13A is a diagram illustrating a 24-bit RGB representation of a pixel and a 32-bit representation of a pixel in the new color model. The 32-bit here is for illustrative purposes and the number of bits should be minimized to balance the color resolution and performance. The upper encoding 1302 represents a pixel using a total of twenty-four bits that are segmented into a lower 8-bit portion 1304, a middle 8-bit portion 1306, and an upper 8-bit portion 1308. Eight bits are allocated for each of the three red, green, and blue component values, which together represent the color of the pixel. For example, a fully saturated shade of red is represented when the eight bits of the red component in the upper 8-bit portion are ones and the eight bits of the green and blue components in the middle and lower 8-bit portions are zeros. The lower encoding 1310 represents a pixel in the new color model using a total of thirty-two bits of storage. In one implementation, the 32 bits of storage are segmented into three 7-bit portions 1312, 1314, and 1316, a 10-bit portion 1318, and a 1-bit portion 1320. In order to achieve an adequate number of color intensity levels, seven bits of data are used to represent each percentage coordinate of the new-color-model coordinates. The first 7-bit portion 1312 is allocated for the percentage value of black $P_k$ and the second 7-bit portion 1314 is allocated for the percentage value of $P_w$. The 1-bit portion 1320 is a flag bit indicating whether or not the pixel corresponds to a purple color. When the pixel does not correspond to a purple color, the third 7-bit portion 1316 from bit 14 to bit 20 is allocated for the percentage value of a spectral color and the 10-bit portion 1318 from bit 21 to bit 30 is allocated for the wavelength value of the spectral color. When the pixel represents a purple color, the third 7-bit portion 1316 from bit 14 to bit 20 are allocated for the percentage value of red and another seven bits from bit 21 to bit 27 within the 10-bit portion are allocated for the percentage value of blue. The upper three bits, from bit 28 to bit 30, of the 10-bit portion are filled with zeros.

Figure 13B:
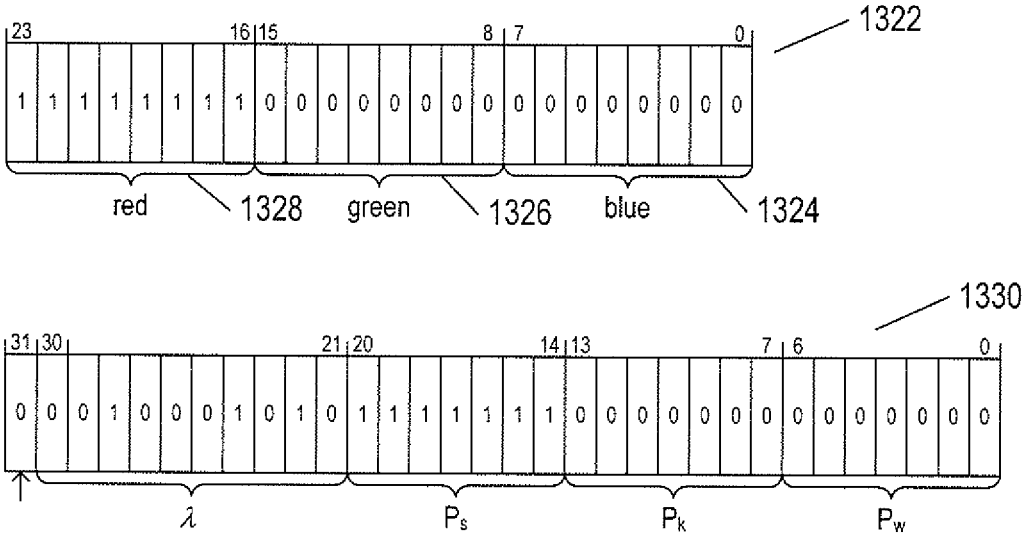
FIG. 13B is a diagram illustrating a color-system conversion from a 24-bit RGB representation to a 32-bit representation in the new color system using a fully saturated shade of red as an example.

FIG. 13B is a diagram illustrating a color coordinate conversion from the 24-bit RGB representation to the 32-bit representation in the new color system using a fully saturated shade of red as an example. A fully saturated shade of red is represented in a 24-bit pixel 1322 in which the eight bits of the red component in the upper 8-bit portion 1324 are ones and the eight bits of the green and blue components in the middle and lower 8-bit portions 1326 and 1328 are zeros. To convert the red color pixel from the 24-bit RGB encoding to the 32-bit new-model encoding, the wavelength of the red color pixel is determined to have a value of 650 nm. The percentage of the red spectral color has a value of 100, since the red color is fully saturated, and the percentages of black and white are both zero. By converting the analog values to digital values, the 24-bit fully saturated red can be represented in a 32-bit pixel (1330), in which the seven bits in the first and second 7-bit portions are zeros, the seven bits in the third 7-bit portion are ones, the 10-bit portion has bit values of "1101010101", representing the 10-bit digital value of the wavelength, and bit 31 is 0, indicating that the color pixel is non-purple. The 10-bit digital value of the wavelength is calculated using the following equation:

$$DV=(\lambda_{AV}-\lambda_{min})/r$$

where DV is the digital value of the wavelength; $\lambda_{AV}$ is the analog value of the wavelength, in this case, 650 nm; $\lambda_{min}$ is the minimum wavelength value, in this case, 400 nm; and the resolution r is defined as $700-400/2^{10}$.

The number of bits varies for different RGB encodings. Some devices may be configured to generate 24-bit color, while other devices may be configured to generate more or less than twenty-four bits of color. For a 24-bit RGB encoding, there are 256 shades of red, green, and blue, for a total of 16,777,216 possible colors that need to be transformed to the new color model. For an 8-bit RGB encoding, there are a total of 256 possible colors that need to be transformed. The transformation may be performed analytically based on mathematical expressions. Alternatively, the transformation may be performed empirically based on color-matching experiments or semi-empirically by applying adjustments to values computed from mathematical expressions. The output values of the transformation may be stored in the form of a color look-up table when a display panel is placed into operation. Input encodings are used as indexes or addresses for accessing equivalent new-model encodings in the look-up table. The data stored at each address in the table is the output value of the coordinate transformation when the input variables have values equal to the value of the address.

Figure 14:
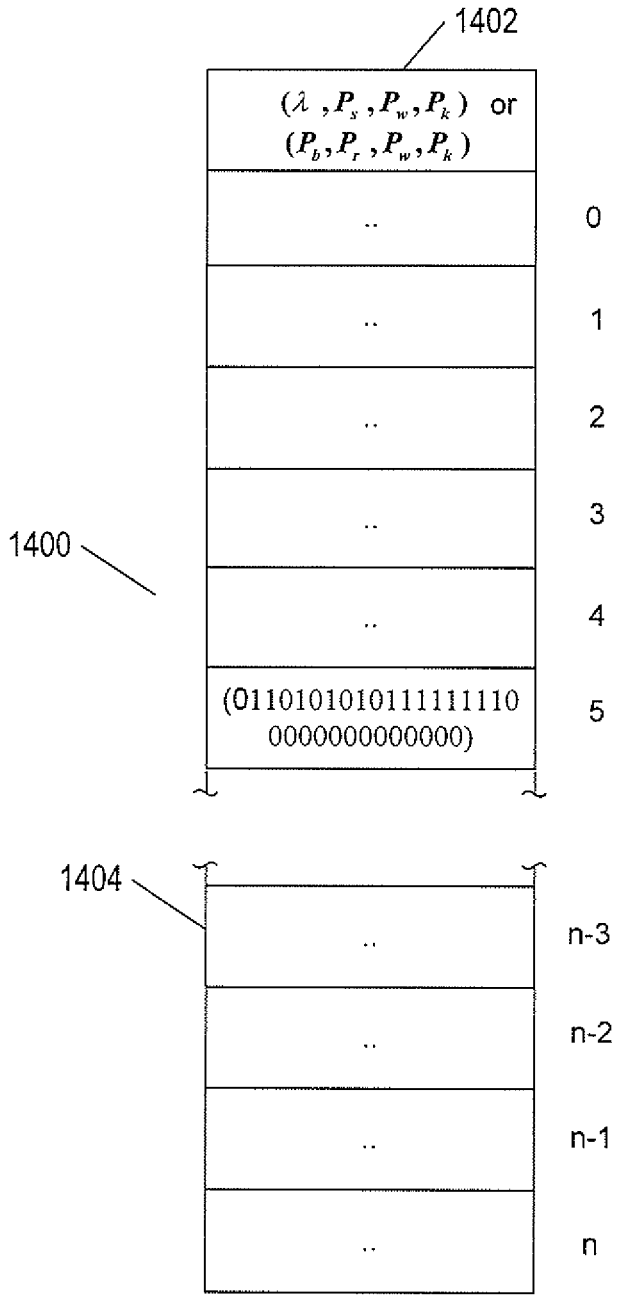
FIG. 14 provides an exemplary color look-up table.

FIG. 14 provides an exemplary color look-up table. The color look-up table 1400 contains one column 1402, representing a set of 32-bit coordinate encodings in the new color model. Each entry in column 1402 corresponds to a color in the RGB color model. For example, a color pixel with index value 5 represents a red component with bits 11111111, a green component with bits of 00000000, and a blue component with bits of 00000000 in the 24-bit RGB format and corresponds to a 32-bit transformed new-model encoding shown in table cell 1404. The number of entries contained in the color look-up table varies depending on the bit depth of the input color model.

Figure 15A:
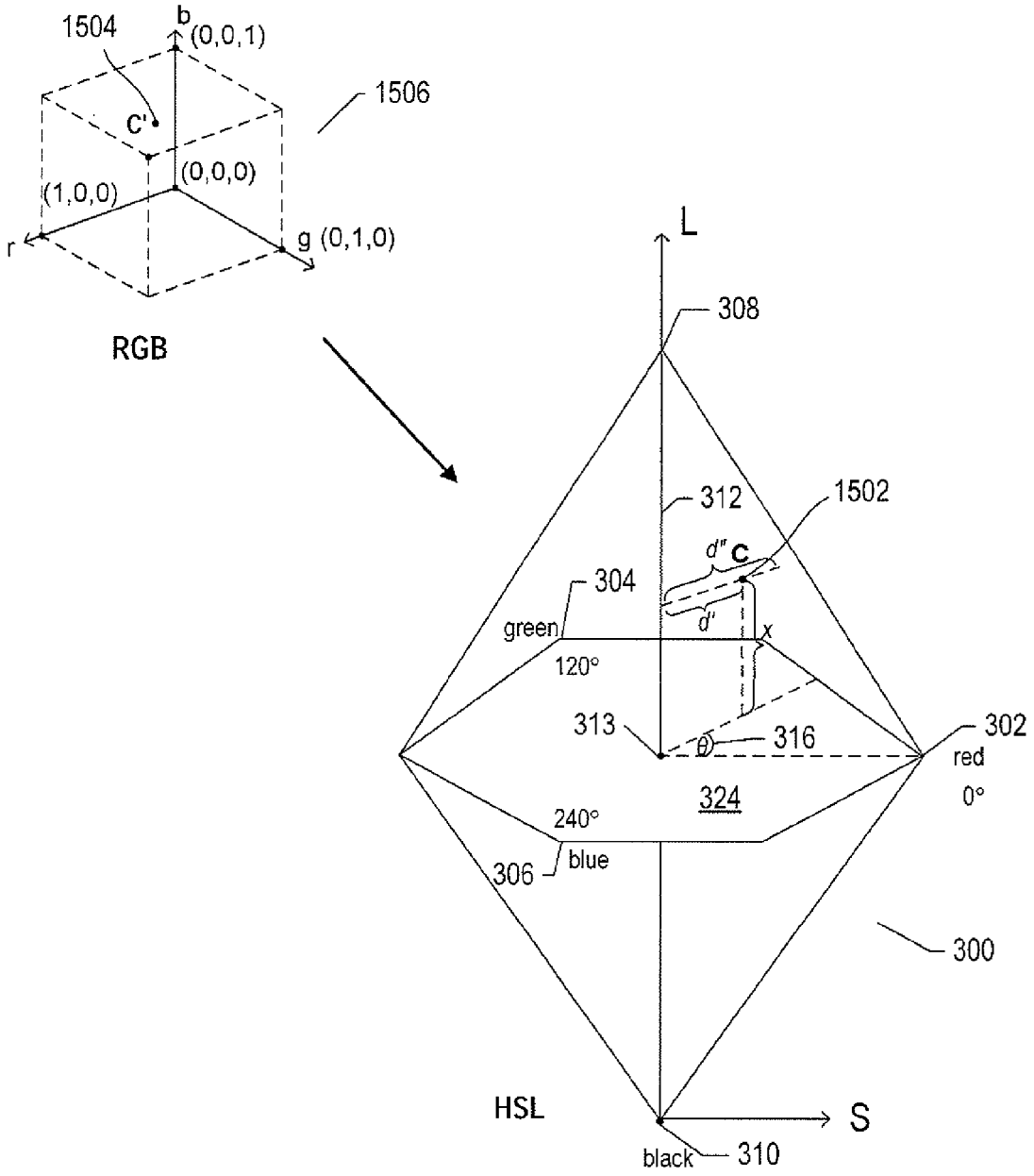
FIG. 15A shows an HSL color model used as an example to describe the conversion from a RGB system to the new color system.

FIG. 15A shows a conversion from RGB coordinates to the new-model color coordinates using a HSL color model as an example. A detailed implementation is given below, with reference to FIG. 15A, to describe how the wavelength of a spectral color and percentages of various color components are determined for a given color represented by a 24-bit RGB encoding. The HSL color model previously shown in FIG. 3 is used as an example in order to demonstrate how the coordinate transformation is performed. However, many other color models can be used for the coordinate transformation, including the CIE XYZ color model or the CIE LUV color model. The coordinates for a particular color in the 24-bit RGB color model, (r, g, b), can be converted to the coordinates of the color in the HSL color model, (h, s, l), using previously described equations (1) to (3). For example, color point C 1502 in the HSL color model 300, with coordinates ($h_c$, $s_c$, $l_c$), corresponds to point C' 1504 in the RGB color model 1506. The percentage of hue is defined as:

$$P_s = \frac{d'}{d''}(1.00-2x),\ d' \neq 0,\ x \in (0, 0.5)$$

$$P_s = 0,\ d' = 0$$

where d' is the distance from point C to the central vertical axis 312; d" is the length of a horizontal line passing through point C from the central vertical axis 312 to the surface of the bi-pyramidal prism 300; and x is the vertical height of point C with respect to the plane 324 that includes the origin 313 and fully saturated colors 302, 304, and 306. The percentage of white is defined as:

$$P_w = \frac{d'}{d''}(1.00-2x)*l_c,\ x \in (0, 0.5)$$

where $l_c$ is the lightness. The percentage of black is defined as:

$$P_k = \frac{d'}{d''}(1.00-2x)*(1-l_c)$$

$$l_c \in (0, 1.00)$$

The sum of $P_s$, $P_w$, and $P_k$ is equal to 1.0.

When the percentage of hue $P_s$ is not equal to zero and the hue of point C, defined by angle θ 316, falls in the range of [0°, 240°], the dominant monochromatic wavelength of the hue can be determined and corresponds to the wavelength of a spectral color. There are different approaches to determine the dominant monochromatic wavelength, λ, of the given color point C in the HSL color model or point C' in the RGB color model. In one implementation, the dominant wavelength is derived from angle θ of color point C in the HSL color model. The dominant wavelength λ is determined by color-mapping hues in the range of [0°, 240° ] to a spectral wavelength between 700 nm and 450 nm. The color mapping may be performed using one or more wavelength-hue look-up tables. FIG. 15B provides an exemplary wavelength-hue look-up table for hues in the range of [0°, 240° ]. Hue is used as an index into the look-up table, and the data entry stored at each index in the table is the wavelength value of the corresponding hue. For example, index 0 corresponds to a wavelength of 700 nm, index 120 corresponds to a wavelength of 550 nm, and index 240 corresponds to a wavelength of 450 nm. The wavelength in the wavelength-hue look-up table may be determined using an analytical color operator f(θ) applied to the hue or determined empirically or semi-empirically.

For non-spectral hues in the range of [241°, 359°], which are hues that cannot be represented by a single wavelength, but are instead generated as a mixture of blue and red, a blue ratio, f, is determined and mapped to each non-spectral hue. The blue ratio, f, is defined as:

$$f = \frac{\theta - 240}{120}$$

FIG. 15C provides an exemplary ratio-hue look-up table for non-spectral hues. Again, hue is used as an index to the look-up table, and the value stored at each index in the table is the blue ratio f of the corresponding hue. The look-up table is indexed by hue in the range of [241°, 359°]. For example, index 241 corresponds to a blue ratio of 0.99, while index 359 corresponds to a blue ratio of 0.01. The percentage of blue $P_b$ and the percentage of red $P_r$ are calculated from the blue ratio as follows:

$$P_b = f * P_s$$

$$P_r = (1-f) P_s$$

Similar to the wavelength, the blue ratio may be determined using an analytical color operator f'(θ) applied to the hue or determined empirically or semi-empirically.

In alternative implementations, the chromaticity diagram shown in FIG. 7 may be used to determine the dominant wavelength associated with the hue. The color point C' in the RGB color model is transformed to a corresponding color point C" in the CIE chromaticity diagram by converting the (r,g,b) coordinates to the (x,y) coordinates using previously described equations (4)-(8). Using the approach previously described with reference to FIG. 7, the dominant wavelength of the given color C' is determined as the wavelength associated with an intersection point on the spectral locus when the interaction point falls on the spectral locus. When the intersection point falls on the line of purples, a blue ratio for the purple color is calculated.

Figure 16:
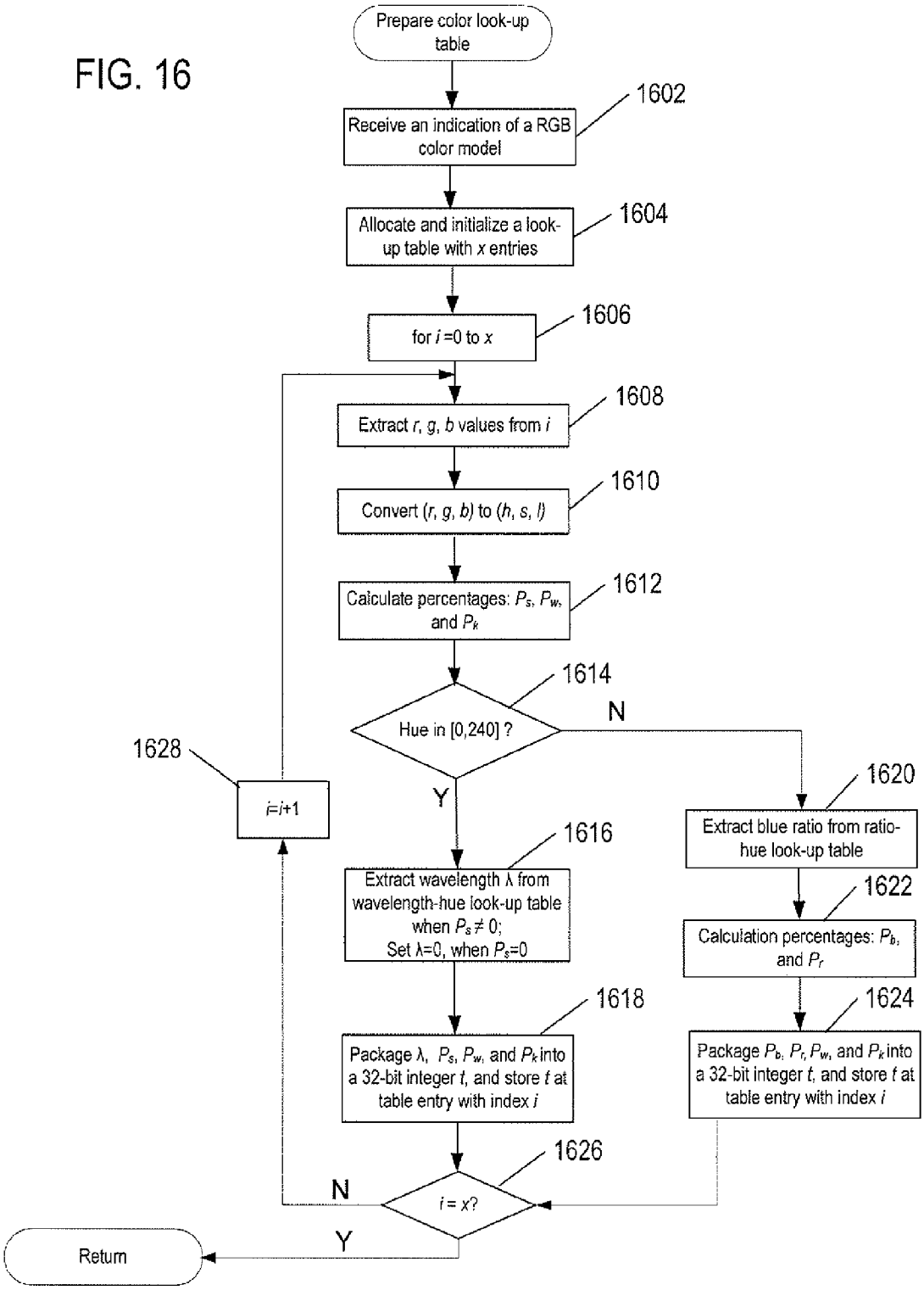
FIG. 16 shows a flow chart for a routine that prepares a color look-up table, using the HSL model as an example.

FIG. 16 shows a flow chart for a routine that prepares the color look-up table, using the HSL model as an example. In step 1602, the routine receives an indication of a RGB color model, for example, a 24-bit RGB color model. A look-up table with x entries is allocated and initialized in step 1604. In the for-loop of steps 1606-1628, for i from 0 to x, the r, g, b values are extracted, in step 1608, from the current value of i and converted to the h, s, l values in the HSL color model, in step 1610. In step 1612, the percentages of hue, $P_s$, black $P_k$, and white $P_w$ are calculated. Decision block 1614 determines whether or not the hue of i falls in the range of [0,240]. When the hue of i is in the range of [0,240], control flows to step 1616 in which the dominant wavelength λ of the hue is extracted from one or more wavelength-hue look-up tables when $P_s$ is not equal to zero or the dominant wavelength λ is set to zero when $P_s$ is zero. In step 1618, the routine packages the wavelength 2 and the three percentages $P_s$, $P_k$, and $P_w$ into a 32-bit integer t and stores at a table entry with index i. When the hue of i is not in the range of [0,240], control flows to step 1620 in which the blue ratio f of the hue is extracted from one or more ratio-hue look-up tables. The percentages of blue $P_b$ and red $P_r$ are calculated in step 1622. In step 1624, the routine packages the four percentages $P_b$, $P_r$, $P_k$, and $P_w$ into a 32-bit integer t and stores t at a table entry with index i. Decision block 1626 determines whether or not i is equal to x. When i=x, the routine terminates. Otherwise, control flows to step 1608 to process the next color point with value i=i+1.

Various color dithering algorithms, such as spatial dithering, temporal dithering, or a combination of both, can then be used to mix color components, which are one or more spectral colors, black, and white, to produce any desired color. In certain implementations, when the temporal dithering method is used, a desired non-purple color can be dithered from sequencing a spectral color associated with a dominant wavelength, black, and white for certain durations over a frame period of T. The durations for the spectral color, black, and white can be determined from the percentage of each color component, respectively. For example, the duration of the spectral color, t, is calculated by multiplying the frame period T by the percentage of the spectral color P. The duration of black, $t_k$, is calculated by multiplying the frame period T by the percentage of black $P_b$. Similarly, the duration of white, $t_w$, is calculated by multiplying the frame period T by the percentage of white $P_w$. The durations of black and white define the saturation and lightness of the color, while the spectral color defines the hue. In the color generation process, a pixel switches and resides in its first color state for a specific duration, then switches and resides in its second color state for a specific duration, and finally switches and resides in its third color state until the frame period elapses. The order of sequencing the three color components may be altered among different frame periods to mitigate any possible motional color-breakup problems. The color state of each pixel is controlled by the cavity depth in the SPIM which is, in turn, controlled by the applied voltages, in order to reflect the spectral color, black, and white. Since the color components need to be combined to generate the desired color, the modulators generally have a very high response speed to switch from one color state to another. When pure white is desired to be reflected from a pixel, the pixel reflects full incident light during the entire frame period. To generate a color with 100% saturation, the dominant wavelength associated with the spectral color is reflected uninterruptedly during the entire frame period.

In other implementations, a spatial dithering method may be used to mix one or more spectral colors, black, and white. Spatial dithering divides a pixel into many smaller addressable sub-pixels and separately drives the individual sub-pixels in order to obtain gray scales of a particular color. Each sub-pixel is a discrete SPIM and switches from one color component to another by varying the depth of the SPIM cavity to reflect a spectral color, black, or white. A number of gray scale levels for a desirable color may be displayed by each individual pixel by varying the percentages of the three color components.

Figure 17:
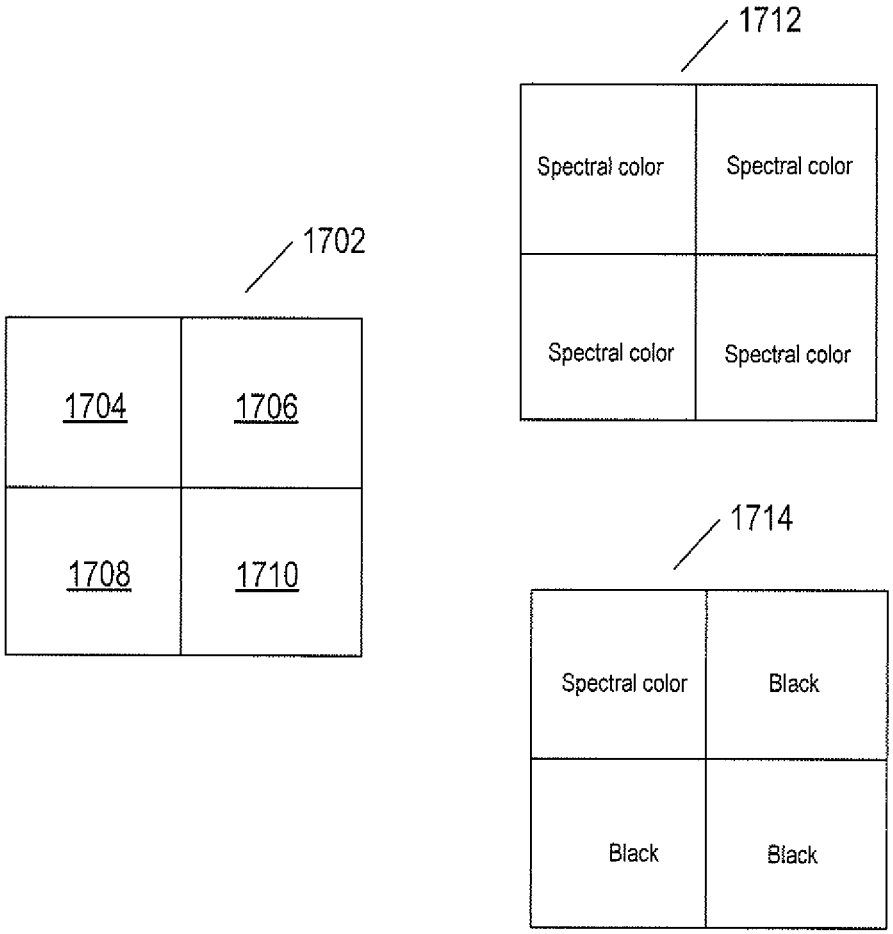
FIG. 17 shows a spatial dithering scheme that divides a pixel into 4 sub-pixels.

FIG. 17 shows a spatial dithering scheme that divides a pixel into 4 sub-pixels. A pixel can be divided into any number of sub-pixels. When a pixel 1702 is divided into 4 sub-pixels 1704, 1706, 1708, and 1710, each pixel 1702 is capable of producing ten gray scale levels for each of spectral colors. For example, a pixel 1712 having a scale of 100% of the spectral color, 0% of black, and 0% of white may be perceived as a color with maximal intensity, while a pixel 1714 having a scale of 25% of the spectral color, 75% of black, and 0% of white may be perceived as a color with the minimal intensity. The number of sub-pixels per pixel, e.g. 4 bits, may be referred to as the bit of gray scale resolution.

In alternative implementations, a hybrid color dithering method can be achieved using combinations of temporal and spatial dithering methods. Using the spatial dithering scheme shown in FIG. 17 as an example, each of the spatially-mixed sub-pixels within a pixel can be subdivided into sub-frames, each sub-frame corresponding to one of the color components that make up a color. The time durations associated with each sub-frame over a frame period may be varied to generate a spectrum of gray-scale levels. Hybrid color dithering displays can be designed to increase the number of gray scales and to maximize color depth while maintaining satisfactory color and spatial resolution. In addition, the response speed requirement for the SPIM is not as high in spatial dithering as for the temporal dithering. By combining spatial dithering with temporal dithering, the display does not need to be refreshed as often as when temporal dithering is used alone.

A System for Controlling a Reflective Display Panel

Figure 18:
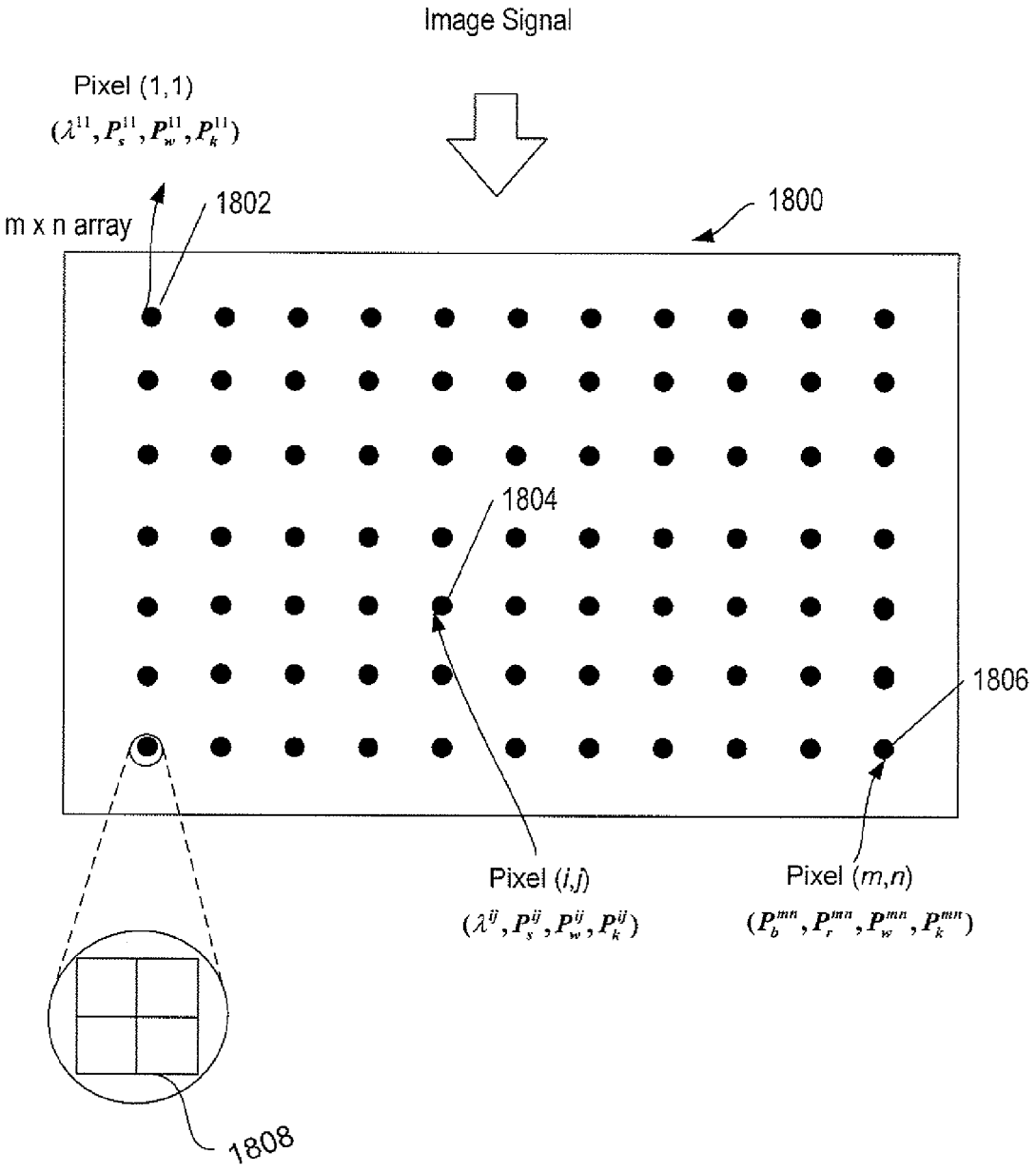
FIG. 18 is a schematic display image frame.

FIG. 18 is a schematic display image frame. An image to be processed 1800, for example, a bmp picture file, is received, represented as an m×n dimension array, with each dot representing a pixel. Pixel 1802 has display coordinate (1,1), pixel 1806 has display coordinate (n,m), and each pixel has a pair of coordinate (i,j) with i indexing the row and j indexing the column of the m×n array. Each pixel in the image is associated with a quadruplet, for example, a wavelength of a spectral color and percentages of the spectral color, black and white for non-purple colors and percentages of blue, red, black and white for purple colors. For example, a non-purple pixel 1802 is associated with ($\lambda^{11}$, $P_s^{11}$, $P_w^{11}$, $P_k^{11}$), another non-purple pixel point 1804 is associated with ($\lambda^{ij}$, $P_s^{ij}$, $P_w^{ij}$, $P_k^{ij}$), and purple pixel point 1806 is associated with ($P_b^{mn}$, $P_r^{mn}$, $P_w^{mn}$, $P_k^{mn}$). When a temporal-dithering method is used to mix the color components, the percentage color coordinates associated with each pixel can be converted into time durations over a frame period. For example, pixel 1802 is associated with color coordinates ($\lambda^{11}$, $t_s^{11}$, $t_w^{11}$, $t_k^{11}$) and pixel 1806 is associated with color coordinates ($t_b^{mn}$, $t_r^{mn}$, $t_w^{mn}$, $t_b^{mn}$). Each pixel in the image may be a SPIM, as shown in FIG. 11. In cases when spatial dithering is used, each pixel is divided into a number of sub-pixels 1808, for example four sub-pixels, with each sub-pixel implemented as a SPIM. A full-image display is rendered by spatially assembling a plurality of SPIMs in rows and columns on a substrate layer, each reflecting a particular color. Appropriate predefined voltages are sequentially applied to the electrodes of each SPIM to vary the cavity depth of the SPIM in order to reflect a spectral color of a certain wavelength.

Calibration and color correction processes are required for a reflective display panel to reflect a consistent color gamut. The reflected color gamut is sampled and analyzed to determine voltages that need to be applied to the electrodes of each pixel to achieve a desired color. Using the SPIM shown in FIG. 11 as an example, to reflect a particular color, there are potentially three voltages that need to be applied to three electrodes on the bottom control plate. A series of voltage combinations is applied to each SPIM to establish a voltage-wavelength relationship between the applied voltages and the wavelength reflected by that SPIM. Alternatively, a common voltage-wavelength relationship may be used to represent a group of SPIMs due to the fact that SPIMs on a display panel are subject to similar manufacturing conditions. The voltage-wavelength relationships for each different group of SPIMs may be stored and indexed in one or more voltage-wavelength look-up tables in a driver circuit, a control unit, or the memory of a host device for use in driving the display panel. The stored voltage data is referenced both for color realization and tilt correction.

Figure 19:
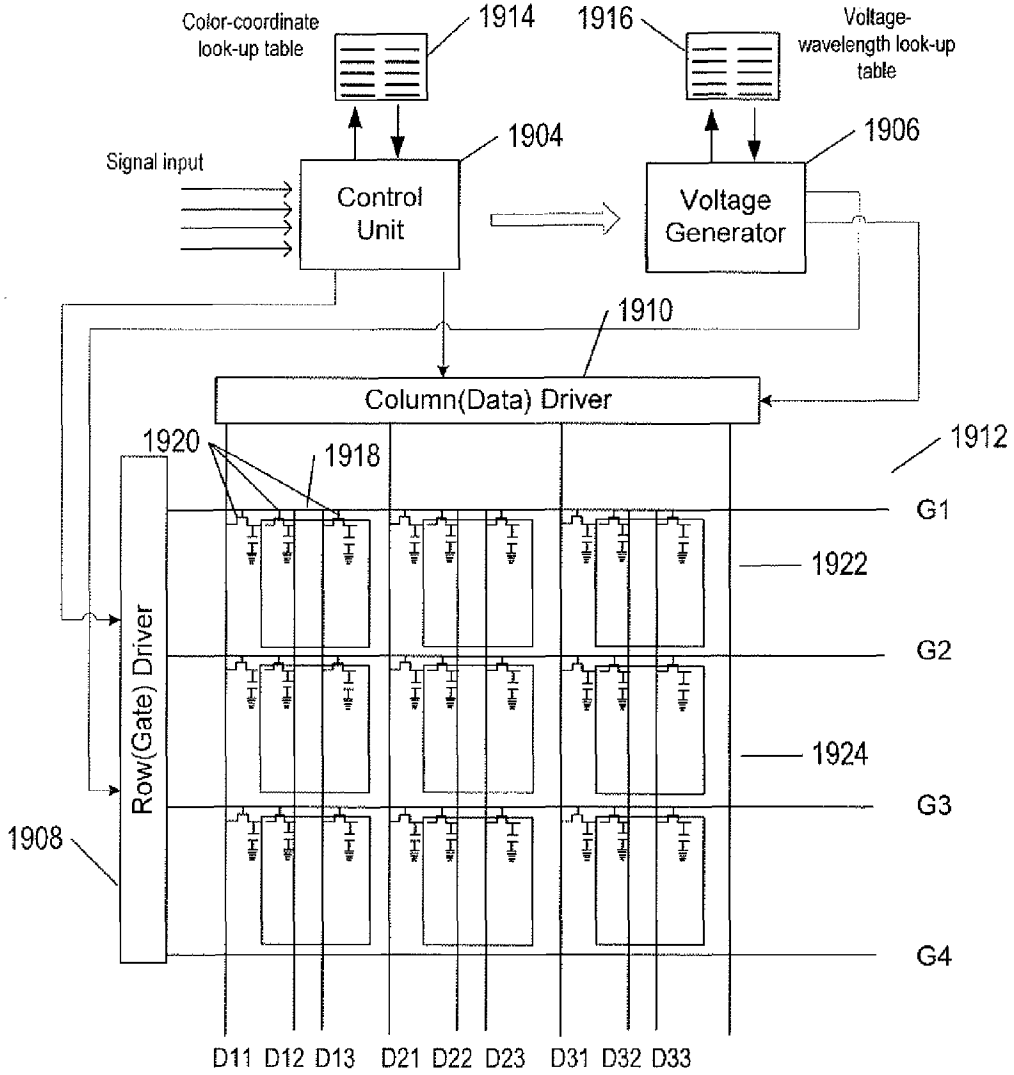
FIG. 19 shows a system diagram of a signal processing circuit of a reflective display panel.

FIG. 19 shows a diagram of a signal processing circuit of a reflective display panel. In one implementation, the signal processing circuit of the reflective display panel shown in FIG. 19 consists of a control unit 1904, a voltage generator 1906, a row driver 1908, a column driver 1910, and a pixel matrix 1912. For clarity of illustration, the pixel matrix 1912 contains only three adjacent rows and three adjacent columns of SPIMs, which provides nine unit pixels. A unit pixel may correspond to a pixel or to a sub-pixel when pixels are further divided into sub-pixels. The signal processing circuit receives an electrical video/image signal having a standard format, such as a 24-bit RGB format. The received signal is transmitted to the control unit 1904 in which the signal is transformed from the 24-bit RGB coordinates to 32-bit coordinates in the new color model. The transformation is made by using one or more color look-up tables 1914. The control unit 1904 determines the dithering method to be used and color coordinates that need be produced for each unit pixel in the display, and generates timing and voltage signals to control the voltage generator 1906. The voltage generator 1906 is controlled by the control unit 1904 in accordance with a predefined voltage-wavelength relationship table 1916 to apply appropriate voltages to row and column drivers 1908 1910 of the display. The row and column drivers drive the display panel to display images. The pixel matrix 1912 is horizontally connected to the row driver 1908 through data lines and vertically connected to the column driver 1910 through gate lines. Each unit pixel in the pixel matrix is controlled by an SPIM containing a plurality of electrodes connected to a gate line and at least one data line through one or more TFTs. In certain implementations, three data lines are needed in order to maintain the movable plate parallel to the top plate and to eliminate tilting of the movable plate of the SPIM, as previously discussed. For example, unit pixel 1918 in the pixel matrix is controlled by an SPIM containing three electrodes connected to gate line G1 and three data lines D11, D12, and D13 through three TFTs 1920. The row driver 1908, also called the gate driver, is operated to generate a gate pulse along a gate line, controlling one row of unit pixels at a time by turning "ON" or "OFF" the TFT switch of every unit pixel in that row. For example, when row 1922 is selected and the TFT switches in row 1922 are turned on, the column driver 1910, also called the data driver, delivers voltage signals through data lines D11, D12, D13, D21, D22, D23, D31, D32, and D33 and applies the voltages simultaneously to all columns to charge each unit pixel in row 1922 to a desired voltage. Next, the TFT switches in row 1922 are turned off, and the succeeding row 1924 is selected and the TFT switches in row 1924 are turned on. The column driver 1920 delivers another set of voltage signals through data lines and applies data voltages to unit pixels in row 1924. Similar to an active-address LCD, unit pixels in the reflective display are scanned line by line. By scanning the gate lines sequentially and by applying data voltages to the data lines in a specified sequence, every unit pixel on the reflective display panel can be addressed and charged to a desired voltage.

When temporal dithering is used to mix the three color components, a frame period can be divided into a number of time slices to synchronize with the horizontal scan rate and to allow a color image to be generated with varying intensities or grayscale levels. The number of time slices may vary for various applications. For example, in a frame that is divided into $2^n-1$ time slices, an SPIM may generate up to $2^n$ possible levels of gray scale for each of the pixels, corresponding to $2^n$ different intensities or shades of a particular color.

Figure 20:
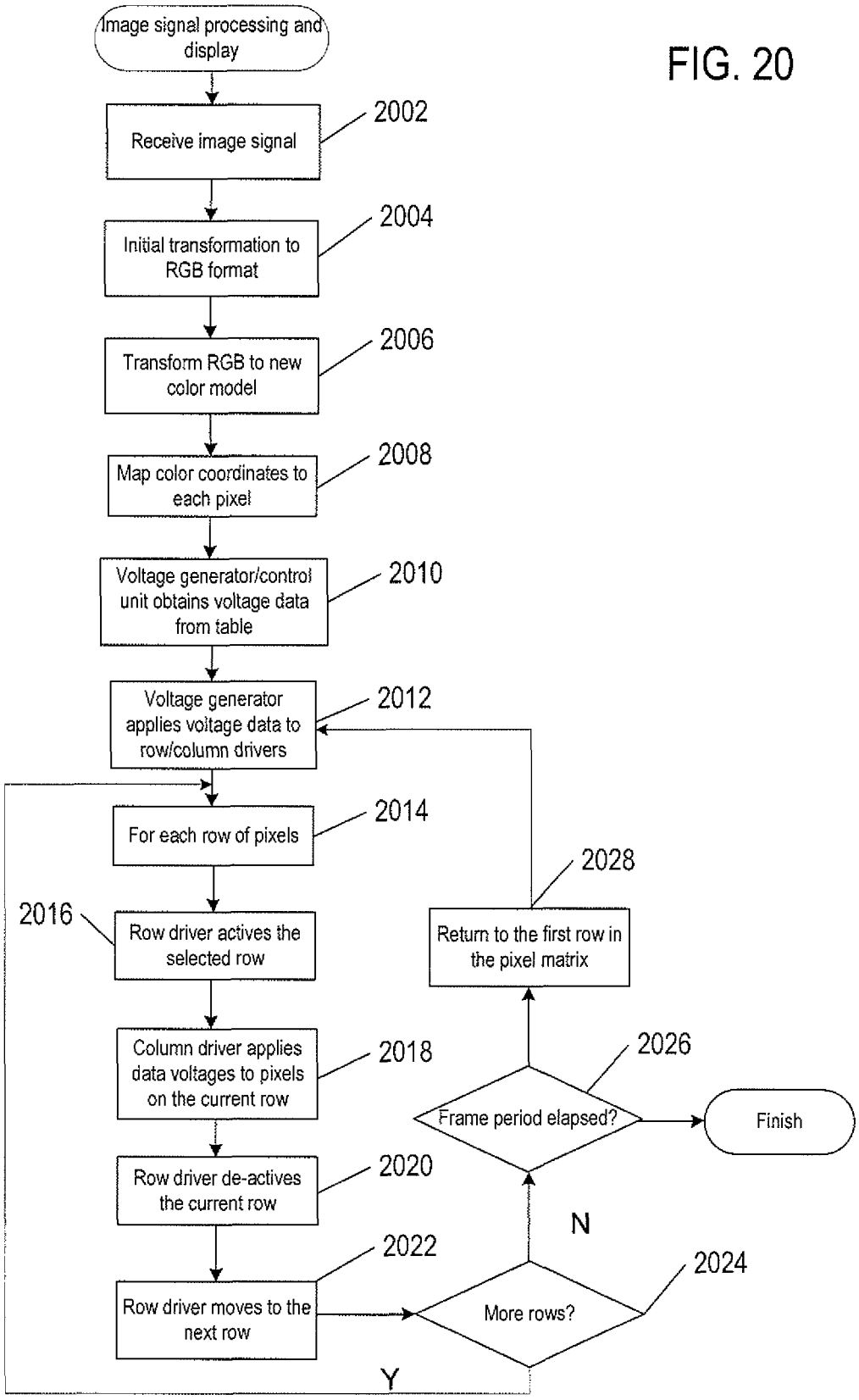
FIG. 20 illustrates a control-flow diagram for video/image processing using the reflective-color-display technology disclosed in the current document.

FIG. 20 illustrates a control-flow diagram for processing video/image signal using the reflective color display technology disclosed in the current document. The control-flow diagram shows the image processing steps in one frame period using temporal dithering technique as an example. In one implementation, a video or image input signal in one or more standard encodings, such as composite encodings, S-Video encodings, HDMI encodings, or other encodings, is received, in step 2002, and decoded and initially processed by the signal processing circuit system of a display device, in step 2004, to transform the input signal to a first common signal encoding, for example, the 24-bit RGB encoding. In step 2006, the input signal is further processed by the signal processing circuit to transform 24-bit RGB coordinates to 32-bit coordinates in the new color model and subsequently to the time durations within a certain frame period. In step 2008, the control unit of the signal processing circuit maps color coordinates ($\lambda$, $t_s$, $t_w$, $t_k$) or ($t_b$, $t_r$, $t_w$, $t_k$) for each pixel. As noted above, the control unit can use various color dithering methods, such as the spatial dithering, temporal dithering, or a combination of both, to produce any desired color at each pixel. The temporal dithering technique is used as one example in the control-flow diagram. When the control unit specifies a color for each pixel, a voltage generator or the control unit obtains voltage data from one or more predefined voltage-wavelength look-up tables in step 2010, and the voltage generator applies the obtained voltage data to row/column drivers of the display device in step 2012. In the for-loop of steps 2014-2024, for each row of pixels, the row driver turns on the TFT switches on the selected row in step 2016. In step 2018, the column driver applies data voltages obtained from the voltage-wavelength relationship table to pixels on the currently selected row. In response to the applied voltage, the cavity depth of the SPIM associated with each pixel on the currently selected row is adjusted to a particular value to reflect a particular color. Next, the row driver de-activates the currently selected row in step 2020 and moves to the next row in step 2022. Decision block 2024 determines whether or not more rows in the pixel matrix are available for scanning. When more rows are available, control flows back to step 2014. Otherwise, control flows to decision block 2026 to determine whether or not the current frame period has elapsed. When the current frame period has elapsed, the routine terminates. Otherwise, control flows to step 2028, in which the row and column drivers return to drive the first row in the pixel matrix. Control then returns to step 2012 to start a new time slice within the current frame period.

Although the present disclosure has been described in terms of particular implementations, it is not intended that the disclosure be limited to these implementations. Modifications within the spirit of the disclosure will be apparent to those skilled in the art. For example, implementations disclosed in the document use RGB and CIE color models as examples to demonstrate the coordinate transformation to the new color model. Other device-dependant or device-independent color models may also be used as an input for the color-coordinate transformation. It is not intended that the scope of these concepts in any way be limited by the choice of the input color model. Some implementations demonstrate the use of temporal dithering technique for achieving a color mixture, but other dithering algorithms may also be used to mix the three color components to produce any desirable color. The foregoing descriptions of specific implementations of the present disclosure are presented for purposes of illustration and description.

It is appreciated that the previous description of the disclosed implementations is provided to enable any person skilled in the art to make or use the present disclosure. Various modifications to these implementations will be readily apparent to those skilled in the art, and the generic principles defined herein may be applied to other implementations without departing from the spirit or scope of the disclosure. Thus, the present disclosure is not intended to be limited to the implementations shown herein but is to be accorded the widest scope consistent with the principles and novel features disclosed herein.

The invention claimed is:

1. A system for controlling interferometric modulators of reflective display devices to display information, the system comprising:

a display that includes an array of pixels, each pixel comprising one or more self-parallelizing interferometric modulators; and a control unit that receives a color encoding of a first type for each pixel, transforms the color encoding of the first type to a color encoding of a second type that specifies spectral, black, and white components of a target color, and controls each pixel to display the target color encoded by the color encoding of the second type corresponding to the pixel;

wherein the self-parallelizing interferometric modulator comprises a fixed top plate and a movable plate that are separated by a cavity with an adjustable depth, and a plurality of electrodes; and wherein the self-parallelizing interferometric modulator reflects black when the depth of the cavity has a value selected from among:

greater than or equal to a first threshold and below or equal to 190 nm; and 360 nm.

2. A system for controlling interferometric modulators of reflective display devices to display information, the system comprising:

a display that includes an array of pixels. each pixel comprising one or more self-parallelizing interferometric modulators; and a control unit that receives a color encoding of a first type for each pixel, transforms the color encoding of the first type to a color encoding of a second type that specifies spectral, black, and white components of a target color, and controls each pixel to display the target color encoded by the color encoding of the second type corresponding to the pixel;

wherein the self-parallelizing interferometric modulator comprises a fixed top plate and a movable plate that are separated by a cavity with an adjustable depth, and a plurality of electrodes; and wherein the self-parallelizing interferometric modulator reflects a spectral color when the depth of the cavity is in the range of 200 nm to 350 nm.

3. A system for controlling interferometric modulators of reflective display devices to display information, the system comprising:

a display that includes an array of pixels, each pixel comprising one or more self-parallelizing interferometric modulators; and a control unit that receives a color encoding of a first type for each pixel, transforms the color encoding of the first type to a color encoding of a second type that specifies spectral, black, and white components of a target color, and controls each pixel to display the target color encoded by the color encoding of the second type corresponding to the pixel;

wherein the self-parallelizing interferometric modulator comprises a fixed top plate and a movable plate that are separated by a cavity with an adjustable depth, and a plurality of electrodes; and wherein the self-parallelizing interferometric modulator reflects white when the depth of the cavity has a value selected from among:

greater than 1500 nm; and less than or equal to a second threshold that is less than 100 nm.

4. A system for controlling interferometric modulators of reflective display devices to display information, the system comprising:

a display that includes an array of pixels, each pixel comprising one or more self-parallelizing interferometric modulators; and a control unit that receives a color encoding of a first type for each pixel, transforms the color encoding of the first type to a color encoding of a second type that specifies spectral, black, and white components of a target color, and controls each pixel to display the target color encoded by the color encoding of the second type corresponding to the pixel;

wherein the color encoding of the second type for each pixel consists of four values:

a first percentage of blue;

a second percentage of red;

a third percentage of black; and a fourth percentage of white.

5. A system for controlling interferometric modulators of reflective display devices to display information, the system comprising:

a display that includes an array of pixels, each pixel comprising one or more self-parallelizing interferometric modulators; and a control unit that receives a color encoding of a first type for each pixel, transforms the color encoding of the first type to a color encoding of a second type that specifies spectral, black, and white components of a target color, and controls each pixel to display the target color encoded by the color encoding of the second type corresponding to the pixel;

wherein the control unit controls each pixel to display the target color using a color dithering method selected from among spatial dithering, temporal dithering, and a combination of spatial dithering and temporal dithering; and wherein, when temporal dithering is selected, the control unit calculates the time durations of spectral, black, and white components over a frame period for each pixel.

6. A system for controlling interferometric modulators of reflective display devices to display information, the system comprising:

a display that includes an array of pixels, each pixel comprising one or more self-parallelizing interferometric modulators; and a control unit that receives a color encoding of a first type for each pixel, transforms the color encoding of the first type to a color encoding of a second type that specifies spectral, black, and white components of a target color, and controls each pixel to display the target color encoded by the color encoding of the second type corresponding to the pixel;

wherein the control unit controls each pixel to display the target color using a color dithering method selected from among spatial dithering, temporal dithering, and a combination of spatial dithering and temporal dithering; and wherein, when spatial dithering is selected, each pixel is divided into a number of sub-pixels, each sub-pixel corresponding to a self-parallelizing interferometric modulator.

7. A method for controlling interferometric modulators of reflective display devices to display information, the method comprising:

providing an array of pixels, each pixel comprising one or more self-parallelizing interferometric modulators;

receiving a color encoding of a first type for each pixel;

transforming the color encoding of the first type to a color encoding of a second type that specifies spectral, black, and white components of a target color; and controlling each pixel to display the target color encoded by the color encoding of the second type corresponding to the pixel;

wherein the self-parallelizing interferometric modulator comprises a fixed top plate and a movable plate that are separated by a cavity with an adjustable depth, and a plurality of electrodes;

wherein the depth of the cavity is controlled by applying voltages to the plurality of electrodes; and wherein the self-parallelizing interferometric modulator reflects a spectral color when the depth of the cavity is in the range of 200 nm to 350 nm.

* * * * *